US010173448B2

(12) United States Patent
Murata et al.

(10) Patent No.: US 10,173,448 B2
(45) Date of Patent: Jan. 8, 2019

(54) RIBBON CASSETTE INCLUDING SPRING MEMBER FOR APPLYING TENSION TO INK RIBBON

(71) Applicant: Brother Kogyo Kabushiki Kaisha, Nagoya-shi, Aichi-ken (JP)

(72) Inventors: Susumu Murata, Konan (JP); Khairul Fatasha Mohd, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/718,213

(22) Filed: Sep. 28, 2017

(65) Prior Publication Data

US 2018/0015758 A1 Jan. 18, 2018

Related U.S. Application Data

(63) Continuation of application No. PCT/JP2016/070669, filed on Jul. 13, 2016.

(30) Foreign Application Priority Data

Jul. 13, 2015 (JP) ..... 2015-139573

(51) Int. Cl.
*B41J 2/325* (2006.01)
*B41J 32/00* (2006.01)
*B41J 17/32* (2006.01)

(52) U.S. Cl.
CPC ..... *B41J 32/00* (2013.01); *B41J 2/325* (2013.01); *B41J 17/32* (2013.01)

(58) Field of Classification Search
CPC ..... B41J 32/00; B41J 3/36; B41J 17/32; B41J 2/35; B41J 2/355; B41J 2/3551; B41J 2/3553; B41J 2/3555; B41J 2/3556; B41J 2/3558
See application file for complete search history.

(56) References Cited

FOREIGN PATENT DOCUMENTS

| | | | |
|---|---|---|---|
| JP | S61-154876 | A | 7/1986 |
| JP | H10-006625 | A | 1/1998 |
| JP | 2009-101649 | A | 5/2009 |
| JP | 2011-206916 | A | 10/2011 |
| JP | 5625632 | B2 | 11/2014 |

OTHER PUBLICATIONS

Jan. 25, 2018—(WO) IPRP—App PCT/JP2016/070669.
Sep. 20, 2016—International Search Report—Intl App PCT/JP2016/070669.

*Primary Examiner* — Kristal Feggins
(74) *Attorney, Agent, or Firm* — Banner & Witcoff, Ltd.

(57) ABSTRACT

A ribbon cassette includes: a cassette case having first and second holes; an ink ribbon; first and second spools; an engaging part; and a spring member. The ink ribbon has one end wound on the first spool, and another end connected to a first end portion of the second spool. The spring member is wound around a second portion of the second spool. The spring member includes: a winding part wound around the second portion; and an extension part extending from the winding part and engaged with the engaging part. The winding part is wound in a direction opposite to a take-up direction of the second spool. A second draw-out load applied to the ink ribbon being pulled from the second spool through the second hole is smaller than a first draw-out load applied to the ink ribbon being pulled from the first spool through the first hole.

26 Claims, 14 Drawing Sheets

RIBBON CASSETTE INCLUDING SPRING MEMBER FOR APPLYING TENSION TO INK RIBBON

CROSS REFERENCE TO RELATED APPLICATION

This application is a continuation application of International Application No. PCT/JP2016/070669 filed on Jul. 13, 2016, which claims priority from Japanese Patent Application No. 2015-139573 filed Jul. 13, 2015. The entire contents of the earlier applications are incorporated herein by reference.

TECHNICAL FIELD

The present disclosure relates to a ribbon cassette that accommodates an ink ribbon.

BACKGROUND

A ribbon cassette that accommodates an ink ribbon to be used in printing is well known in the art. A ribbon cassette described in Japanese Patent Publication No. 5625632, for example, includes a ribbon spool and a take-up spool that are rotatably supported in a cassette case. An ink ribbon is wound around the ribbon spool. The take-up spool draws the ink ribbon off the ribbon spool and takes up the ink ribbon that was used for printing characters and the like. A clutch spring is provided on a bottom end of the take-up spool. The clutch spring applies a rotational load to the take-up spool when an external force is applied to the take-up spool for rotating the spool in a direction opposite the direction in which ink ribbon is taken up. With this structure, a state in which suitable tension is applied on the ink ribbon is maintained.

SUMMARY

In the conventional ribbon cassette, a user may generate slack in the ink ribbon by pressing on the same, for example. In such cases, it is difficult to return the slackened ink ribbon in the conventional ribbon cassette to a state in which suitable tension is applied.

It is an object of the present disclosure to provide a ribbon cassette that is capable of returning a slackened ink ribbon to a state in which suitable tension is applied.

A ribbon cassette according to a first aspect of the present disclosure includes: a cassette case having a box shape; an ink ribbon accommodated in the cassette case and having a portion exposed to an outside of the cassette case between a first hole formed in a first outer wall of the cassette case and a second hole formed in a second outer wall of the cassette case; a first spool rotatably supported to the cassette case and having a hollow cylindrical shape, one end portion of the ink ribbon being wound on the first spool; a second spool rotatably supported to the cassette case and having a hollow cylindrical shape, the second spool having a first portion to which another end portion of the ink ribbon is connected; an engaging part provided in the cassette case; and a spring member wound around a second portion of the second spool, the second portion being different from the first portion, characterized in that: the spring member includes a winding part wound around the second portion, and an extension part extending from a first end portion of the winding part and engaged with the engaging part; the winding part is wound, from the first end portion, in a winding direction opposite to a take-up direction of the second spool in which the ink ribbon is taken up by the second spool; and a second draw-out load applied to the ink ribbon being pulled from the second spool through the second hole is smaller than a first draw-out load applied to the ink ribbon being pulled from the first spool through the first hole.

A ribbon cassette according to a second aspect of the present disclosure includes: a cassette case having a box shape; an ink ribbon accommodated in the cassette case and having a portion exposed to an outside of the cassette case between a first hole formed in a first outer wall of the cassette case and a second hole formed in a second outer wall of the cassette case; a first spool rotatably supported to the cassette case and having a hollow cylindrical shape, one end portion of the ink ribbon being wound on the first spool; a second spool rotatably supported to the cassette case and having a hollow cylindrical shape, the second spool having a first portion to which another end portion of the ink ribbon is connected; an engaging part provided in the cassette case; and a spring member wound around a second portion of the second spool, the second portion being different from the first portion, characterized in that: the spring member includes a winding part wound around the second portion, and an extension part extending from a first end portion of the winding part and engaged with the engaging part; the winding part is wound, from the first end portion, in a winding direction opposite to a take-up direction of the second spool in which the ink ribbon is taken up by the second spool; and the engaging part is disposed at a position separated farther away from a rotation center of the second spool than a maximum outer circumference of the ink ribbon taken up by the second spool is from the rotation center of the second spool, the maximum outer circumference being defined by taking up the ink ribbon in its entirety around the second spool.

A ribbon cassette according to a third aspect of the present disclosure includes: a cassette case having a box shape; an ink ribbon accommodated in the cassette case and having a portion exposed to an outside of the cassette case between a first hole formed in a first outer wall of the cassette case and a second hole formed in a second outer wall of the cassette case; a first spool rotatably supported to the cassette case and having a hollow cylindrical shape, one end portion of the ink ribbon being wound on the first spool; a second spool rotatably supported to the cassette case and having a hollow cylindrical shape, the second spool having a first portion to which another end portion of the ink ribbon is connected; an engaging part provided in the cassette case; and a spring member wound around a second portion of the second spool, the second portion being different from the first portion, characterized in that: the spring member includes a winding part wound around the second portion, and an extension part extending from a first end portion of the winding part and engaged with the engaging part; the winding part expands in diameter by contacting the extension part against the engaging part when the second spool is applied with an external force to rotate the second spool in a take-up direction in which the ink ribbon is taken up by the second spool, and the winding part contracts in diameter by contacting the extension part against the engaging part when the second spool is applied with an external force to rotate the second spool in a direction opposite to the take-up direction while the extension part elastically deforms; and a second draw-out load applied to the ink ribbon being pulled from the second spool through the second hole is smaller than a first draw-out load applied to the ink ribbon being pulled from the first spool through the first hole.

BRIEF DESCRIPTION OF THE DRAWINGS

The particular features and advantages of the disclosure as well as other objects will become apparent from the following description taken in connection with the accompanying drawings, in which.

DETAILED DESCRIPTION

An embodiment of the present disclosure will be described while referring to the accompanying drawings. In the following description, the lower-left, upper-right, upper-left, lower-right, top, and bottom in FIG. 1 will be respectively referred to as the front, rear, left, right, top, and bottom of a printing device 1. The upper-right, lower-left, lower-right, upper-left, top, and bottom in FIG. 7 will be respectively referred to as the front, rear, left, right, top, and bottom of a ribbon cassette 100.

1. Structure of the Printing Device 1

Figure 1:
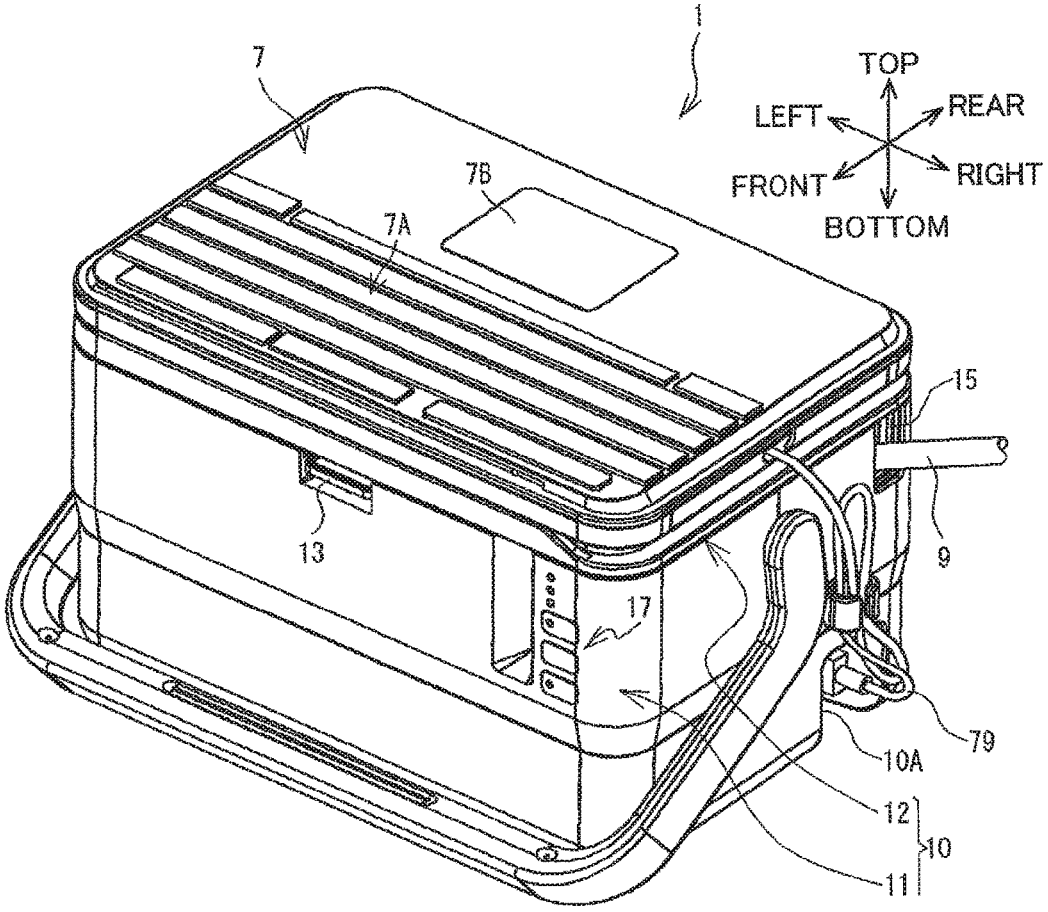
FIG. 1 is a perspective view of a printing device 1 as viewed from a right, front, and upper side thereof.

The printing device 1 will be described with reference to FIGS. 1 through 6. The printing device 1 is a device configured to print on a tube 9, which is a tubular printing medium, while conveying the same, and cut the tube 9 after printing. As illustrated in FIG. 1, the printing device 1 is provided with a housing 10 that includes a main body case 11, and a cover 12. The main body case 11 is a box-like member having a rectangular parallelepiped shape that is elongated in the left-right direction. The cover 12 is a plate-shaped member disposed on the upper side of the main body case 11. A rear end portion of the cover 12 is pivotally movably supported to the rear upper end portion of the main body case 11. A locking mechanism 13 is provided on the front upper end portion of the main body case 11. The locking mechanism 13 locks a front end portion of the cover 12 that is closed with respect to the main body case 11, and restricts opening of the cover 12.

Figure 2:
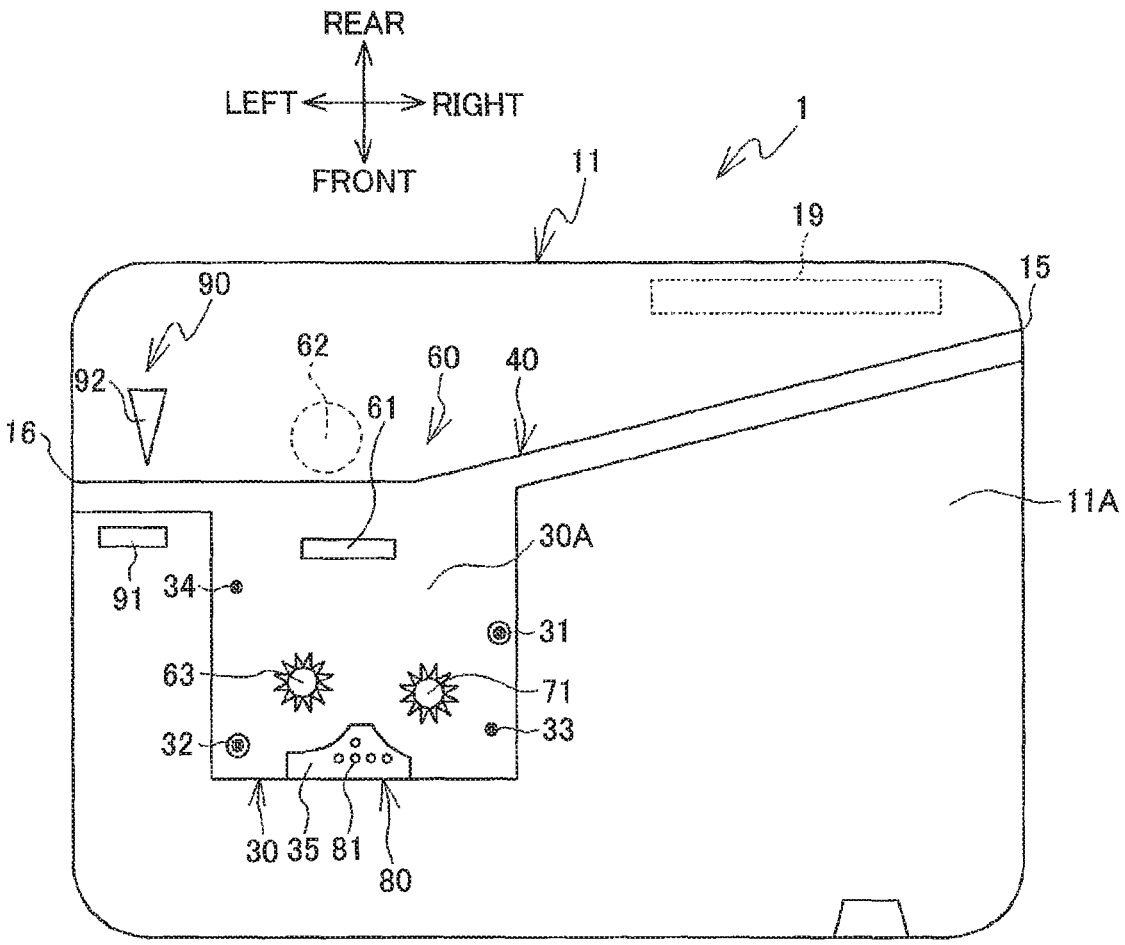
FIG. 2 is a plan view of a main body case 11.
Figure 3:
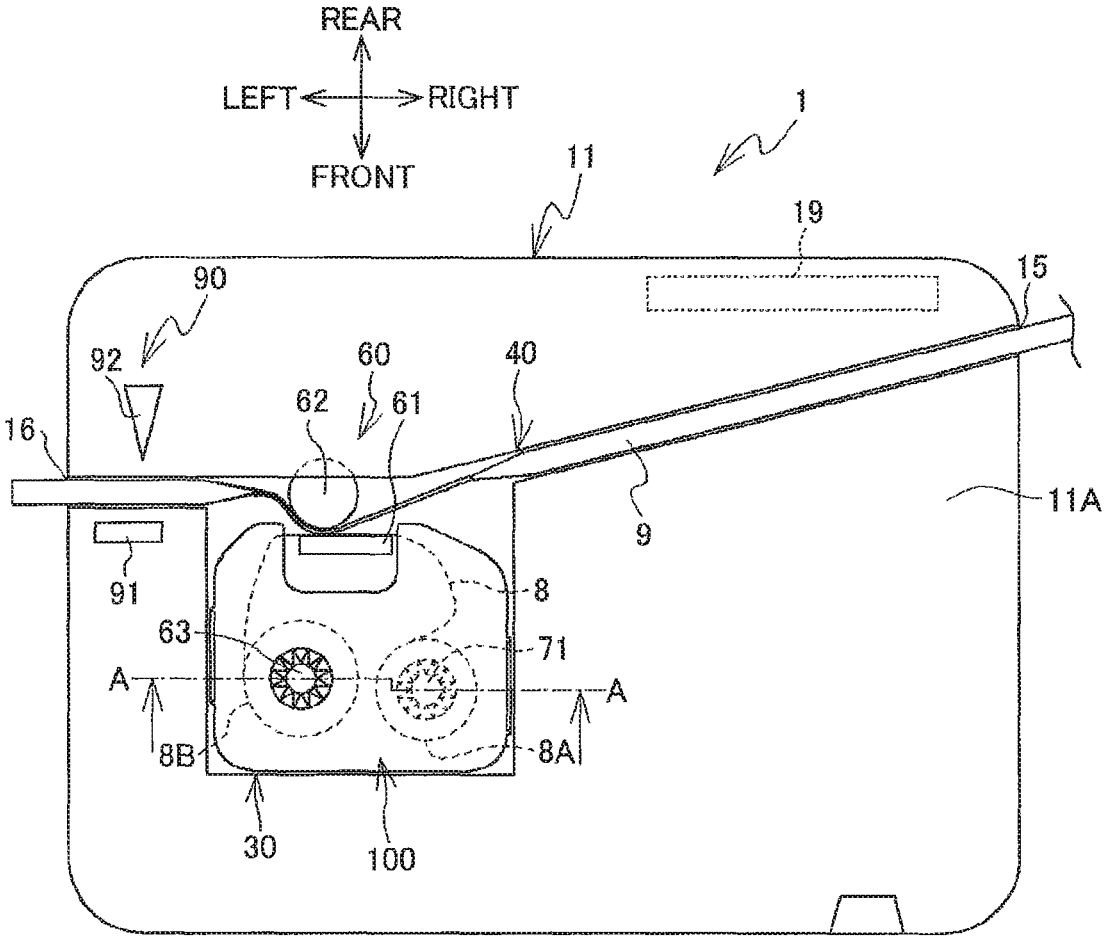
FIG. 3 is a plan view of the main body case 11 to which a tube 9 and a ribbon cassette 100 are mounted.

When the cover 12 is closed with respect to the main body case 11 (see FIG. 1), the cover 12 covers a mounting surface 11A (see FIG. 2). The mounting surface 11A is a top surface of the main body case 11. For opening the cover 12, the user operates the locking mechanism 13 to release the cover 12, allowing the cover 12 to pivotally move upward from the locking mechanism 13. When the cover 12 is opened with respect to the main body case 11, the mounting surface 11A is exposed to an outside.

A keyboard 7 is detachably mounted on a top surface of the cover 12. The keyboard 7 includes an operating section 7A having a plurality of keys, and a display section 7B that displays screens including various information. By operating the operating section 7A, the user can edit characters to be printed on the tube 9 within a screen displayed on the display section 7B. Characters include alphanumeric characters, symbols, graphics, and the like. A USB (Universal Serial Bus) cable 79 is connected to a built-in circuit board (not illustrated) in the keyboard 7. The USB cable 79 can be drawn out rightward from the right surface of the keyboard 7.

An operating section 17, a tube insertion opening 15, and a tube discharge opening 16 (see FIG. 2) are provided in side surfaces of the housing 10. The operating section 17 is configured of a plurality of operating buttons disposed on a front surface of the main body case 11 near the right side thereof. The operating buttons include a power button and a start button. The tube insertion opening 15 is an opening provided in a right side surface of the main body case 11 near the upper-rear corner thereof for guiding the tube 9 into the housing 10. The tube discharge opening 16 is an opening provided in a left side surface of the main body case 11 near the upper-rear corner thereof for discharging the tube 9 from the housing 10. The tube discharge opening 16 is positioned slightly forward of the tube insertion opening 15.

As illustrated in FIG. 2, a ribbon mounting section 30, a tube mounting section 40, and the like are provided in the mounting surface 11A. The ribbon mounting section 30 is a region in which the ribbon cassette 100 is detachably mounted. The ribbon mounting section 30 is a recessed part that is open on the top and whose opening is formed slightly larger than the ribbon cassette 100 in a plan view. The rear portion of the ribbon mounting section 30 is in communication with the tube mounting section 40 in the front-rear direction. The ribbon mounting section 30 of the present embodiment is provided in a left portion of the mounting surface 11A and on the front side of the tube mounting section 40. The user mounts the ribbon cassette 100 into the ribbon mounting section 30 from above so that the upward, downward, leftward, rightward, forward, and rearward directions of the ribbon cassette 100 are aligned with the upward, downward, leftward, rightward, forward, and rearward directions of the printing device 1.

Positioning pins 31 and 32, support pins 33 and 34, and a support part 35 are provided inside the ribbon mounting section 30. The positioning pins 31 and 32 and the support pins 33 and 34 are all columnar-shaped cylindrical shaft members that extend upward from a bottom surface 30A of the ribbon mounting section 30. The top ends of the positioning pins 31 and 32 and support pins 33 and 34 are all at the same vertical position (i.e., height). The positioning pins 31 and 32 have the same diameter. The support pins 33 and 34 have the same diameter, which is smaller than the diameter of the positioning pins 31 and 32.

The positioning pins 31 and 32 are disposed at positions corresponding to respective positioning holes 121 and 122 (see FIG. 9) formed in the ribbon cassette 100 that is mounted in the ribbon mounting section 30. The support pins 33 and 34 are disposed at positions corresponding to respective pin holes 123 and 124 (see FIG. 9) formed in the ribbon cassette 100 that is mounted in the ribbon mounting section 30. In the present embodiment, the positioning pin 31 and support pin 33 are respectively disposed on the right-rear side and right-front side of a rotatable detection shaft 71 described later and are aligned with each other in the approximate front-rear direction. The positioning pin 32 and support pin 34 are respectively disposed on the left-front side and left-rear side of a ribbon take-up shaft 63 described later and are aligned with each other in the approximate front-rear direction. A distance between the positioning pin 32 and support pin 34 in the front-rear direction is slightly greater than a distance between the positioning pin 31 and support pin 33 in the front-rear direction.

The support part 35 is a stepped part that protrudes upward from the bottom surface 30A. The top surface of the support part 35 has a vertical position (i.e., height) equivalent to the top ends of the positioning pins 31 and 32 and support pins 33 and 34. The support part 35 is disposed at a position corresponding to a front recessed part 125 (see FIG. 9) formed in the ribbon cassette 100 that is mounted in the ribbon mounting section 30. In the present embodiment, the support part 35 is disposed at a position aligned with a print head 61 in the front-rear direction and on a line connecting the positioning pin 32 and support pin 33. The top surface of the support part 35 is flat, with a shape corresponding to the front recessed part 125 in a plan view.

The tube mounting section 40 is a region in which the tube 9 is detachably mounted. The tube mounting section 40 is a groove part that is open on the top and that extends from the tube insertion opening 15 to near the right side of the tube discharge opening 16. Since the tube discharge opening 16 is slightly forward of the tube insertion opening 15, the tube mounting section 40 extends in a general left-right direction that slants slightly toward the left-front side. The direction in which the tube mounting section 40 extends from the tube insertion opening 15 toward the tube discharge opening 16 will referred to as a tube-feeding direction. The user mounts the tube 9 in the tube mounting section 40 in the tube-feeding direction such that the tube 9 extends from the tube insertion opening 15 to the tube discharge opening 16.

A control board 19, a printing mechanism 60, a conveyance amount detection unit 70, an indicator detection unit 80, and a cutting mechanism 90 will be described with reference to FIGS. 2 through 5. The control board 19 is a circuit board configured to control operations of the printing device 1. As illustrated in FIG. 2, the control board 19 is disposed in the right-rear section on the inside of the main body case 11 and is connected to a USB connector 18 (see FIG. 6). The USB connector 18 is exposed to the outside of the main body case 11 from a plug accommodating section 10A (see FIG. 1) formed in a bottom part on the right surface of the housing 10 (see FIG. 1). The USB cable 79 (see FIG. 1) led out from the keyboard 7 is connected to the USB connector 18 through the plug accommodating section 10A.

Figure 6:
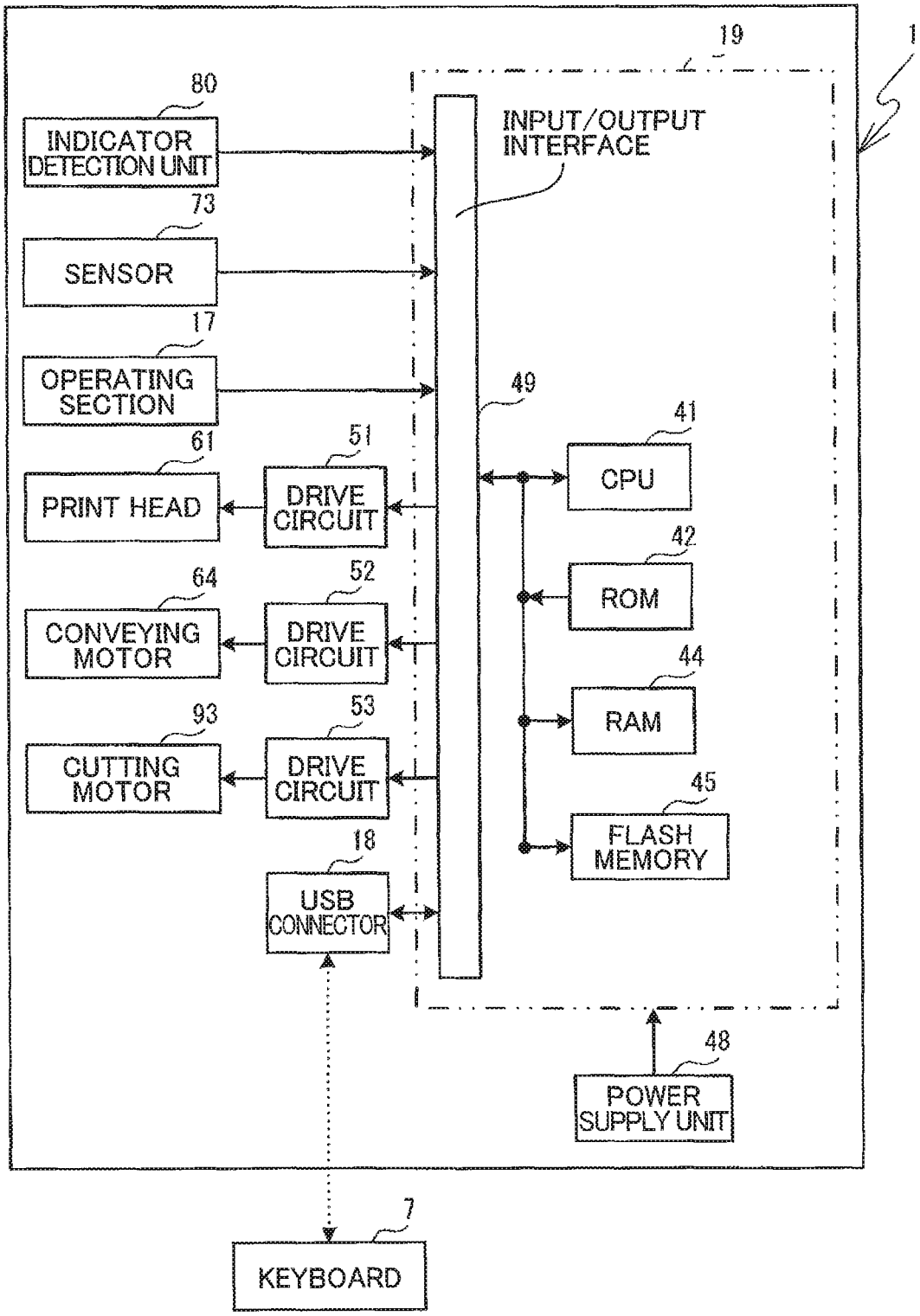
FIG. 6 is a block diagram illustrating an electric structure in the printing device 1.

The printing mechanism 60 includes the print head 61, a movable conveying roller 62, the ribbon take-up shaft 63, and a conveying motor 64 (see FIG. 6). The print head 61 and ribbon take-up shaft 63 upstand from the bottom surface 30A. The print head 61 and ribbon take-up shaft 63 extend higher upward than the positioning pins 31 and 32, support pins 33 and 34, and support part 35.

The print head 61 is a thermal head that includes a heater (not illustrated). The print head 61 is disposed in a position that corresponds to a head insertion section 109 (see FIG. 7) formed in the ribbon cassette 100 that is mounted in the ribbon mounting section 30. In the present embodiment, the print head 61 is disposed in the approximate center of the rear portion of the ribbon mounting section 30.

The ribbon take-up shaft 63 is rotatable together with a take-up spool 300 (see FIG. 4) of the ribbon cassette 100 described later. A plurality of protruding pieces 63A (see FIG. 4) is provided on an outer circumferential surface of the ribbon take-up shaft 63. The protruding pieces 63A are arranged radially and at regular intervals about the axis of the ribbon take-up shaft 63. Each protruding piece 63A protrudes outward in a radial direction from the outer circumferential surface of the ribbon take-up shaft 63 and extends downward from near the top end of the ribbon take-up shaft 63. The ribbon take-up shaft 63 is disposed in a position corresponding to a first support hole 111 (see FIG. 7) formed in the ribbon cassette 100 that is mounted in the ribbon mounting section 30. In the present embodiment, the ribbon take-up shaft 63 is provided in the left portion of the ribbon mounting section 30, forward from the support pin 34 and rearward from the positioning pin 32.

The movable conveying roller 62 is rotatable relative to the print head 61. The movable conveying roller 62 is disposed on the rear side of the ribbon mounting section 30 and is displaceable between a retracted position and an operating position in association with the opening and closing of the cover 12 (see FIG. 1). When in the retracted position, the movable conveying roller 62 is disposed on the rear side of the tube mounting section 40 and is separated from the print head 61 (see FIG. 2). When the movable conveying roller 62 is in the operating position, a portion of the movable conveying roller 62 is disposed inside the tube mounting section 40 and is adjacent to the print head 61 (see FIG. 3).

Figure 4:
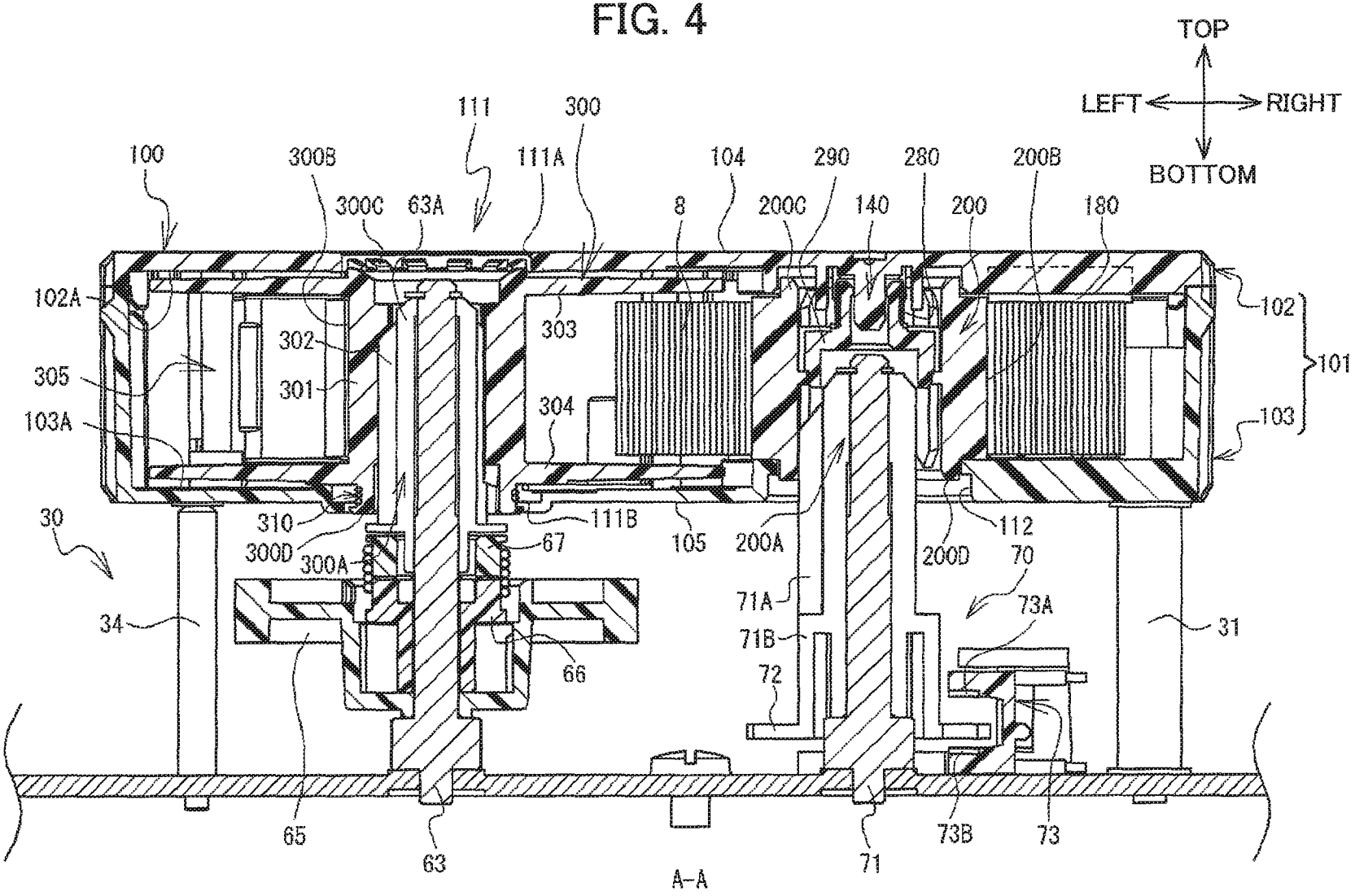
FIG. 4 is a cross-sectional view taken along a line A-A in FIG. 3.

The conveying motor 64 is configured to drive the movable conveying roller 62 and ribbon take-up shaft 63 to rotate. As illustrated in FIG. 4, a disc-shaped gear 65 that is rotatable about the ribbon take-up shaft 63 is provided near the bottom end of the ribbon take-up shaft 63. The gear 65 is coupled to a fixed member 67 via a one-way clutch 66. The fixed member 67 is fixed at a position around the ribbon take-up shaft 63. Through the elastic force of a clutch spring, the one-way clutch 66 allows the ribbon take-up shaft 63 to rotate stably in a prescribed take-up direction (a counterclockwise direction in a plan view in the present embodiment), while restricting the ribbon take-up shaft 63 from rotating in a direction opposite the prescribed take-up direction (a reverse direction, hereinafter).

By rotating the gear 65 in the counterclockwise direction in a plan view, the conveying motor 64 rotates the ribbon take-up shaft 63 in the take-up direction via the one-way clutch 66 and fixed member 67. As the conveying motor 64 rotates the gear 65, the movable conveying roller 62 (see FIG. 2) rotates in the counterclockwise direction in a plan view through a gear train (not illustrated) coupled to the gear 65. In this way, the movable conveying roller 62 and ribbon take-up shaft 63 rotate in synchronism with each other.

The conveyance amount detection unit 70 is a member provided for detecting the conveyance amount of an ink ribbon 8 during a printing operation. As illustrated in FIG. 4, the conveyance amount detection unit 70 includes the rotatable detection shaft 71, a detection plate 72, and a sensor 73. The rotatable detection shaft 71 upstands from the bottom surface 30A (see FIG. 2). The rotatable detection shaft 71 extends farther upward than the positioning pins 31 and 32, support pins 33 and 34, and support part 35. The top end of the rotatable detection shaft 71 is lower than the top ends of the print head 61 and ribbon take-up shaft 63. The rotatable detection shaft 71 is rotatable together with a ribbon spool 200 of the ribbon cassette 100 described later.

As illustrated in FIG. 2, the rotatable detection shaft 71 is disposed in a position corresponding to a second support hole 112 (see FIG. 9) formed in the ribbon cassette 100 that is mounted in the ribbon mounting section 30. In the present embodiment, the rotatable detection shaft 71 is disposed in the rear portion of the ribbon mounting section 30, forward of the positioning pin 31 and rearward of the support pin 33. The axis of the rotatable detection shaft 71 is slightly forward from the axis of the ribbon take-up shaft 63.

Figure 5:
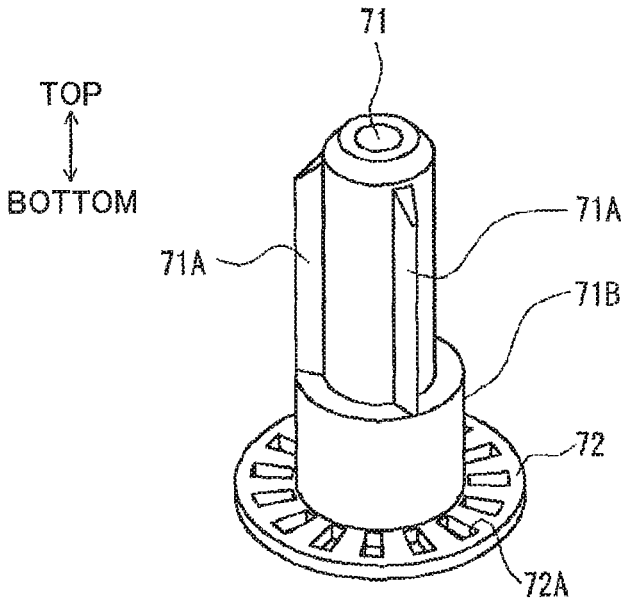
FIG. 5 is a perspective view of a rotatable detection shaft 71.

As illustrated in FIGS. 4 and 5, the rotatable detection shaft 71 includes a plurality of protruding pieces 71A, a cylindrical part 71B, and the detection plate 72. The cylindrical part 71B is a hollow cylindrical member provided around the rotatable detection shaft 71 and is rotatable together with the rotatable detection shaft 71. The plurality of protruding pieces 71A are disposed on an outer circumferential surface of the cylindrical part 71B and are arranged radially and at regular intervals about the axis of the rotatable detection shaft 71. Each protruding piece 71A protrudes radially outward from the outer circumferential surface of the cylindrical part 71B and extends downward from near the top end of the cylindrical part 71B.

The detection plate 72 is disc-shaped and protrudes radially outward from near the bottom end of the cylindrical part 71B. The center of the detection plate 72 in a plan view is aligned with the axis of the rotatable detection shaft 71. As illustrated in FIG. 5, a plurality of detection holes 72A is formed in the detection plate 72. The detection holes 72A penetrate the detection plate 72 vertically and are arranged radially and at regular intervals about the center of the detection plate 72 in a plan view.

The sensor 73 is a transmissive photo-sensor having a light-emitting unit 73A and a light-receiving unit 73B. The light-emitting unit 73A and light-receiving unit 73B are arranged so as to confront each other in the vertical direction interposing the detection plate 72 therebewteen. During a printing operation, a CPU 41 (see FIG. 6) controls the light-emitting unit 73A to irradiate light toward the light-receiving unit 73B. The light irradiated from the light-emitting unit 73A is configured to be received at the light-receiving unit 73B when passing through any of the detection holes 72A. At such times, the sensor 73 outputs an ON signal to the CPU 41. However, the light-receiving unit 73B does not receive the light irradiated from the light-emitting unit 73A when the light is reflected by the detection plate 72. At such times, the sensor 73 outputs an OFF signal to the CPU 41. Note that the sensor 73 may instead be a reflective photo-sensor that can detect light reflected off the detection plate 72.

The indicator detection unit 80 is a member provided for detecting a type indicating part 190 (see FIG. 9) of the ribbon cassette 100. The indicator detection unit 80 has five detection switches 81 provided on a circuit board not illustrated in the drawings. The detection switches 81 are mechanical switches that can advance and retract vertically. The five detection switches 81 are movable vertically through holes formed in the top surface of the support part 35. The five detection switches 81 are disposed in positions corresponding to indicators 191-195 (see FIG. 9) provided on the ribbon cassette 100 that is mounted in the ribbon mounting section 30. In the present embodiment, four detection switches 81 are arrayed in a row in the left-right direction. The remaining detection switch 81 is positioned on the rear side of the second detection switch 81 from the left among these four detection switches 81.

Each detection switch 81 is urged upward by a spring not illustrated in the drawings. The detection switches 81 to which an external force is not applied are moved upward from the support part 35 by the urging force of the springs not illustrated in the drawings to a reference position. The indicator detection unit 80 outputs an OFF signal for the detection switches 81 in the reference position to the CPU 41 described later (see FIG. 6). On the other hand, when the detection switch 81 is pressed downward, the detection switch 81 moves to a depressed position, which is lower than the reference position. The indicator detection unit 80 outputs an ON signal for the detection switches 81 in the depressed position to the CPU 41. The combination of the ON signals and OFF signals for the five detection switches 81 will be referred to as type detection patterns.

The cutting mechanism 90 is configured to execute operations for cutting the tube 9. As illustrated in FIG. 2, the cutting mechanism 90 is provided in the main body case 11 near the left end of the tube mounting section 40. That is, the cutting mechanism 90 is on the downstream side of the print head 61 in the tube-feeding direction. The cutting mechanism 90 includes a receiving plate 91, a cutting blade 92, and a cutting motor 93 (see FIG. 6). The receiving plate 91 has a rectangular parallelepiped shape and is disposed on the front side of the left end of the tube mounting section 40. The cutting blade 92 opposes the receiving plate 91 from the rear side of the tube mounting section 40. The cutting motor 93 is configured to move the cutting blade 92 in the front-rear direction so that the cutting blade 92 moves toward and away from the receiving plate 91.

The electrical structure of the printing device 1 will be described with reference to FIG. 6. The control board 19 includes the CPU 41, a ROM 42, a RAM 44, a flash memory 45, an input/output interface 49, and the like, which components are interconnected via a data bus. The ROM 42 stores programs enabling the CPU 41 to implement various controls including a printing operation. The RAM 44 temporarily stores various data. The flash memory 45 stores a table defining ribbon types corresponding to the type detection patterns. For example, the ribbon type may indicate the color and width of the ink ribbon 8 accommodated in the ribbon cassette 100.

The printing device 1 has a power supply unit 48. The power supply unit 48 is connected to a battery (not illustrated) mounted in the main body case 11 or an external power supply (not illustrated) via a cord, and is configured to supply power to the control board 19. The operating section 17, the USB connector 18, drive circuits 51-53, the sensor 73, and the indicator detection unit 80 are all connected to the input/output interface 49. The USB connector 18 is connected to the keyboard 7 via the USB cable 79 (see FIG. 1). The CPU 41 receives various information inputted via the operating section 17. The CPU 41 receives various commands inputted via the operating section 7A (see FIG. 1) and controls the display of screens on the display section 7B. The CPU 41 receives the ON/OFF signals outputted from the sensor 73 and the type detection patterns outputted from the indicator detection unit 80.

The drive circuits 51-53 are connected to the print head 61, conveying motor 64, and cutting motor 93, respectively. The CPU 41 controls the drive of the print head 61 by transmitting control signals to the drive circuit 51. The CPU 41 controls the drive of the conveying motor 64 by transmitting pulse signals to the drive circuit 52. The CPU 41 controls the drive of the cutting motor 93 by transmitting control signals to the drive circuit 53.

2. Structure of the Ribbon Cassette 100

The ribbon cassette 100 will be described with reference to FIGS. 7 through 12. FIGS. 7 through 10 illustrate the ribbon cassette 100 in an initial state in which the ribbon cassette 100 has not yet been used in a printing operation. In the initial state, the ribbon cassette 100 has an entirely unused ink ribbon 8. A predetermined upper limit quantity of the ink ribbon 8 is wound around the ribbon spool 200. The ink ribbon 8 is not wound around the take-up spool 300 (the same is the case in FIG. 4 described above).

Figure 7:
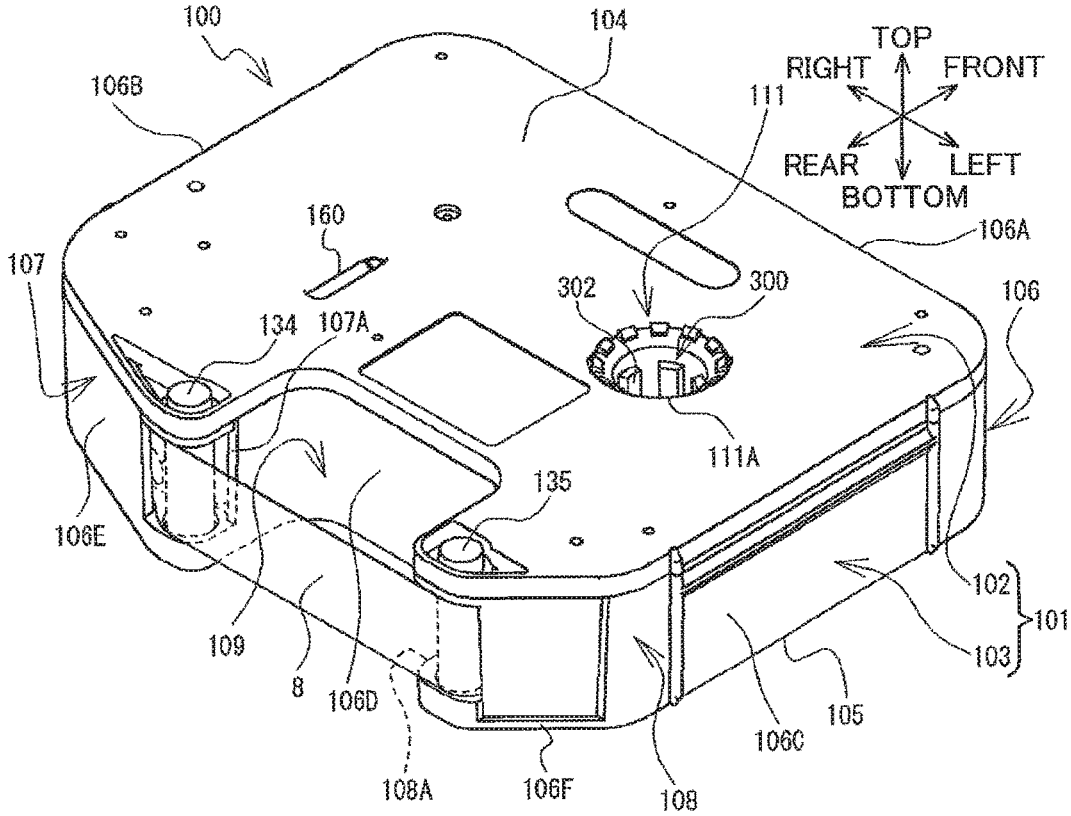
FIG. 7 is a perspective view of the ribbon cassette 100 as viewed from a left, rear, and upper side thereof.
Figure 8:
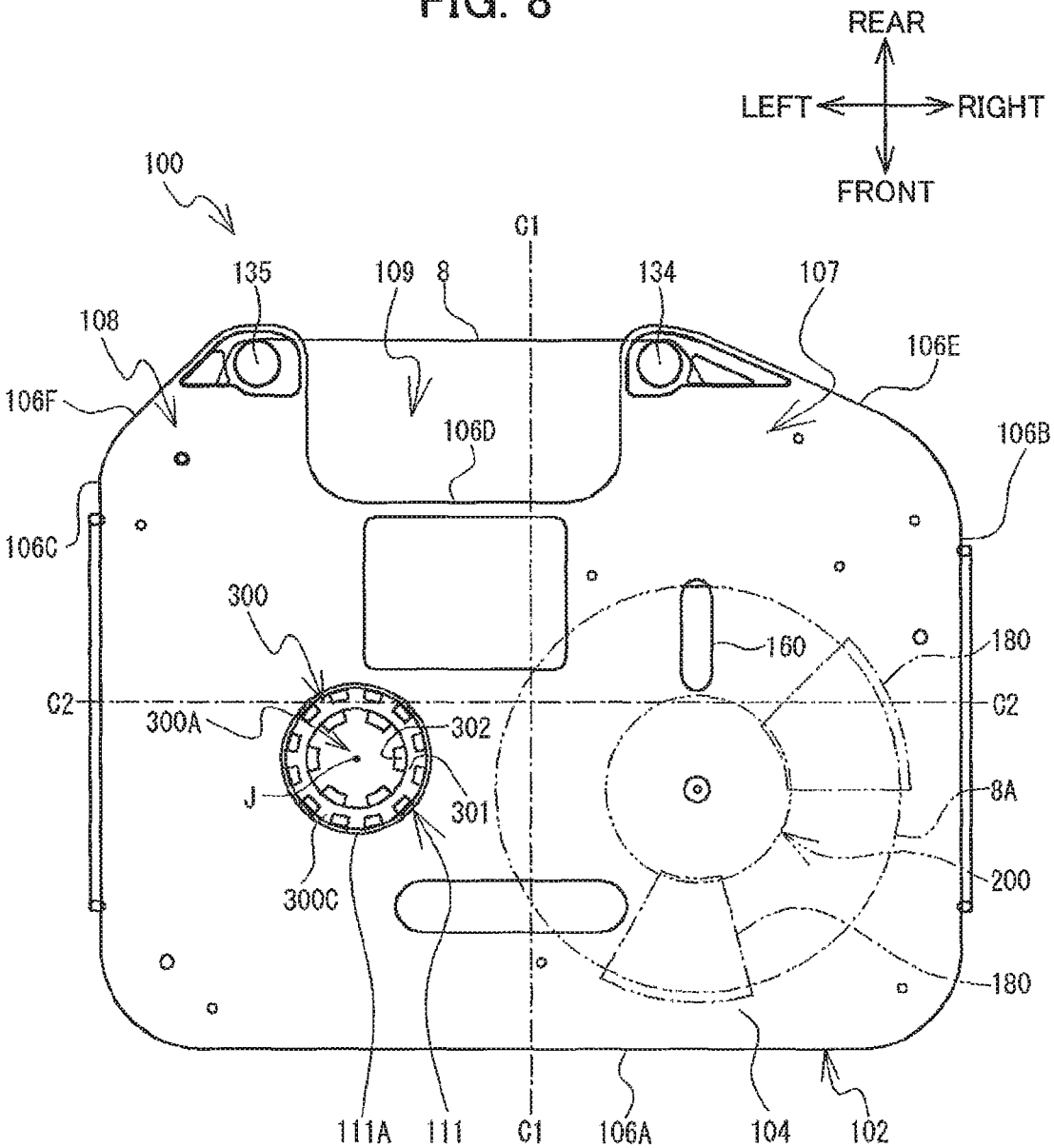
FIG. 8 is a plan view of the ribbon cassette 100.
Figure 9:
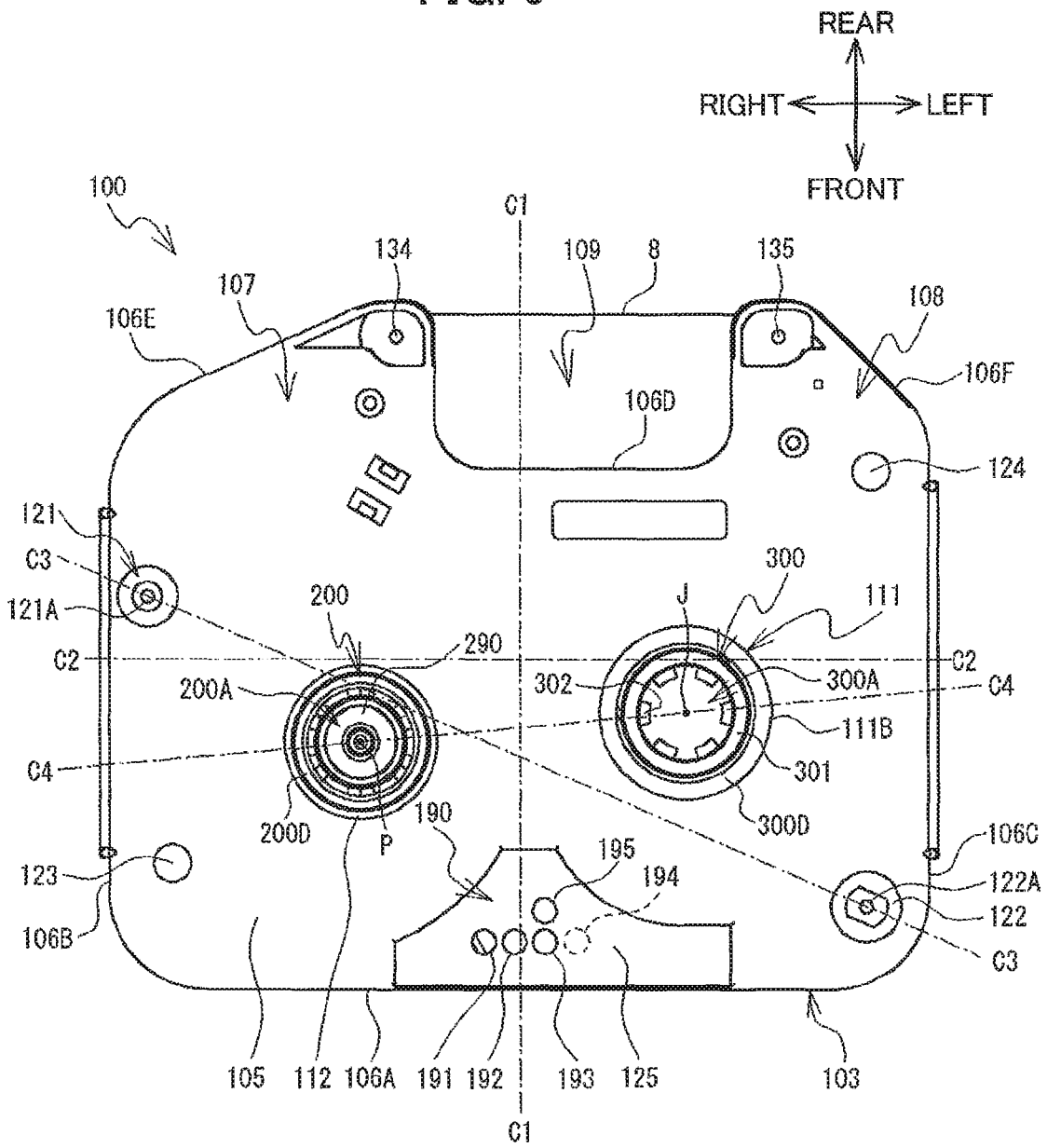
FIG. 9 is a bottom view of the ribbon cassette 100.

As illustrated in FIGS. 7 through 9, the ribbon cassette 100 includes a case 101 that accommodates the ink ribbon 8. The case 101 has a box shape that is long in the left-right direction and short in the vertical direction. The case 101 includes a lower case 103, and an upper case 102 that assembles to the top of the lower case 103. The top surface of the upper case 102 and the bottom surface of the lower case 103 respectively constitute a top surface 104 and a bottom surface 105 of the case 101. The top surface 104 and bottom surface 105 oppose each other vertically and have the same approximate shape in a plan view. An imaginary line extending in the front-rear direction through the left-right center of the case 101 is a centerline C1. An imaginary line extending in the left-right direction through the front-rear center of the case 101 is a centerline C2.

A side surface 106 of the case 101 extends vertically between the top surface 104 and bottom surface 105 and extends along the outer edges of the top surface 104 and bottom surface 105. The side surface 106 includes a front surface 106A, a right surface 106B, a left surface 106C, a head peripheral surface 106D, and connecting surfaces 106E and 106F. The front surface 106A extends in the left-right direction. The right surface 106B and left surface 106C extend rearward and parallel to each other from the respective right edge and left edge of the front surface 106A. The right surface 106B and left surface 106C are aligned with each other in the left-right direction and are substantially equivalent in length in the front-rear direction.

The head peripheral surface 106D is a part of the side surface 106 provided across the centerline C1 in a plan view and recessed forward from the rear edge of the case 101. The connecting surface 106E extends in a direction toward the right-front from the right-rear edge of the head peripheral surface 106D and is connected to the rear edge of the right surface 106B. The connecting surface 106F extends in a direction toward the left-front from the left-rear edge of the head peripheral surface 106D and is connected to the rear edge of the left surface 106C. The length of the connecting surface 106E in its extended direction is greater than the length of the connecting surface 106F in its extended direction.

The head insertion section 109 is an inner region surrounded by the head peripheral surface 106D. The head insertion section 109 penetrates the case 101 vertically and is open toward the rear of the case 101. The head insertion section 109 has a generally rectangular shape that is elongated in the left-right direction in a plan view, and extends across the centerline C1 in the left-right direction. The left-right center of the head insertion section 109 is slightly leftward of the centerline C1.

The portion of the case 101 on the right side of the head insertion section 109 constitutes a first guide part 107. The first guide part 107 has a triangular shape in a plan view and is enclosed by the right surface of the head peripheral surface 106D and the connecting surface 106E. A ribbon outlet 107A is provided in a left-rear edge of the first guide part 107. The ribbon outlet 107A is an opening in communication with the head insertion section 109. The ink ribbon 8 is configured to be conveyed from the inside of the case 101 toward the outside thereof through the ribbon outlet 107A. The portion of the case 101 on the left side of the head insertion section 109 constitutes a second guide part 108. The second guide part 108 has a triangular shape in a plan view and is enclosed by the left surface of the head peripheral surface 106D and the connecting surface 106F. A ribbon inlet 108A is provided in a right-rear edge of the second guide part 108. The ribbon inlet 108A is an opening in communication with the head insertion section 109. The ink ribbon 8 is configured to be conveyed from the outside of the case 101 toward the inside thereof through the ribbon inlet 108A. That is, a portion of the ink ribbon 8 is exposed to the outside of the case 101 between the ribbon outlet 107A and the ribbon inlet 108A.

The case 101 has the first support hole 111 rotatably supporting the take-up spool 300 and the second support hole 112 rotatably supporting the ribbon spool 200 (see FIG. 9). The first support hole 111 is disposed in a left portion of the case 101 and positioned forward of the second guide part 108 and rearward of the front recessed part 125 described later. The first support hole 111 includes an upper hole 111A (see FIG. 8) and a lower hole 111B (see FIG. 9). The upper hole 111A is a circular hole that penetrates the upper case 102 vertically. The lower hole 111B is a circular hole that penetrates the lower case 103 vertically. The upper hole 111A and lower hole 111B have the same diameter and are aligned with each other vertically. The rotational axis passing through the rotational center of the take-up spool 300 that is supported in the first support hole 111 will be referred to as an axis J.

The second support hole 112 is disposed in a right portion of the case 101, farther forward than the first guide part 107 and rearward than the front recessed part 125. The second support hole 112 is a circular opening that penetrates the lower case 103 vertically. The rotational axis passing through the rotational center of the ribbon spool 200 that is supported in the second support hole 112 will be referred to as an axis P. Both axes P and J are forward of the centerline C2. The axis P is farther forward than the axis J.

As illustrated in FIG. 9, the positioning holes 121 and 122, the pin holes 123 and 124, and the front recessed part 125 are provided in the lower case 103. The positioning holes 121 and 122 and the pin holes 123 and 124 are all recessed parts that are recessed upward from the bottom surface 105. The upper ends of the positioning holes 121 and 122 and the pin holes 123 and 124 are positioned at a reference height, which is a predetermined vertical position in the case 101. The reference height is a prescribed distance below the vertical center of the case 101. The prescribed distance is a constant that is independent of the vertical dimension of the case 101 (i.e., the thickness of the case 101).

In the present embodiment, the positioning hole 121 and pin hole 123 are respectively provided on the right-rear side and right-front side of the second support hole 112 and are substantially aligned with each other in the front-rear direction. The positioning hole 121 and pin hole 123 are both near the right surface 106B. The positioning hole 122 and pin hole 124 are respectively provided on the left-front side and left-rear side of the lower hole 111B and are substantially aligned with each other in the front-rear direction. The positioning hole 122 and pin hole 124 are both near the left surface 106C. The positioning hole 122 and pin hole 123 are positioned forward of the centerline C2, while the positioning hole 121 and pin hole 124 are positioned rearward of the centerline C2. A distance in the front-rear direction between the positioning hole 122 and pin hole 124 is greater than a distance in the front-rear direction between the positioning hole 121 and pin hole 123.

The bottom portion of the positioning hole 121 has a circular-shaped opening. The width of the opening at the bottom portion of the positioning hole 121 is slightly larger than the diameter of the positioning pin 31 (see FIG. 2). The top portion of the positioning hole 121 is an anchoring part 121A. The anchoring part 121A has a rounded hole that is closed by a top surface (not illustrated) at the reference height and is open to the bottom. The width of the opening at the anchoring part 121A is smaller than the diameter of the bottom portion of the positioning hole 121 and equivalent to the diameter of the positioning pin 31.

The bottom portion of the positioning hole 122 has a circular-shaped opening similar to the bottom portion of the positioning hole 121. The width of the opening at the bottom portion of the positioning hole 122 is slightly larger than the diameter of the positioning pin 32 (see FIG. 2). The upper portion of the positioning hole 122 is an anchoring part 122A. The anchoring part 122A is a hole that is closed by a top surface (not illustrated) at the reference height and that is open to the bottom. The anchoring part 122A is an elongate hole that extends in a direction from the right-rear to the left-front. The minimum opening width of the anchoring part 122A (i.e., the length of the anchoring part 122A in its transverse direction) is equivalent to the diameter of the positioning pin 32. The anchoring part 121A is positioned at an extension of a straight line following the longitudinal direction of the anchoring part 122A. An imaginary line connecting the centers of the anchoring parts 121A and 122A is a connecting line C3. The connecting line C3 extends substantially parallel to the longitudinal direction of the anchoring part 122A. The axis J is on the left side of the connecting line C3, and the axis P is on the right side of the connecting line C3.

The pin holes 123 and 124 are round holes that are closed on the top ends by top surfaces (not illustrated) positioned at the reference height. The openings of the pin holes 123 and 124 have the same diameter, which is slightly larger than the diameter of the support pins 33 and 34 and smaller than the diameters of the openings formed in the bottom ends of the positioning holes 121 and 122.

The front recessed part 125 is a stepped part that is recessed upward from the bottom surface 105. The top surface of the front recessed part 125 is positioned at the reference height. The front recessed part 125 is in a position aligned with the head insertion section 109 in the front-rear direction and overlaps the line connecting the positioning hole 122 and pin hole 123. Specifically, the front recessed part 125 is disposed on the front end of the lower case 103 and extends across the centerline C1 in the left-right direction. The left edge of the front recessed part 125 is at a position in the left-right direction approximately equal to the left edge of the head insertion section 109. The right edge of the front recessed part 125 is slightly rightward of the right edge of the head insertion section 109 with respect to the left-right direction. The left-right center of the front recessed part 125 is slightly leftward of the centerline C1. The front recessed part 125 extends rearward along the centerline C1 in a bottom view. The rear edge of the front recessed part 125 is at the same approximate position as the pin hole 123 in the front-rear direction.

The type indicating part 190 indicating the ribbon type is provided in the top surface of the front recessed part 125. An imaginary line passing through the axis J and axis P is a connecting line C4. The type indicating part 190 is on the front side of the connecting line C4 and aligned with the head peripheral surface 106D in the front-rear direction. The type indicating part 190 in the present embodiment includes the indicators 191-195. The indicators 191-194 are arranged along the front surface 106A in the left-right direction. The indicator 195 is disposed on the rear side of the indicator 193, which is the second indicator from the left among the indicators 191-194. Each of the indicators 191-195 is configured of either a surface part or a hole part in a pattern corresponding to the ribbon type of the ribbon cassette 100. In the present embodiment, the indicators 191-193 and 195 are hole parts, while the indicator 194 is a surface part.

Figure 10:
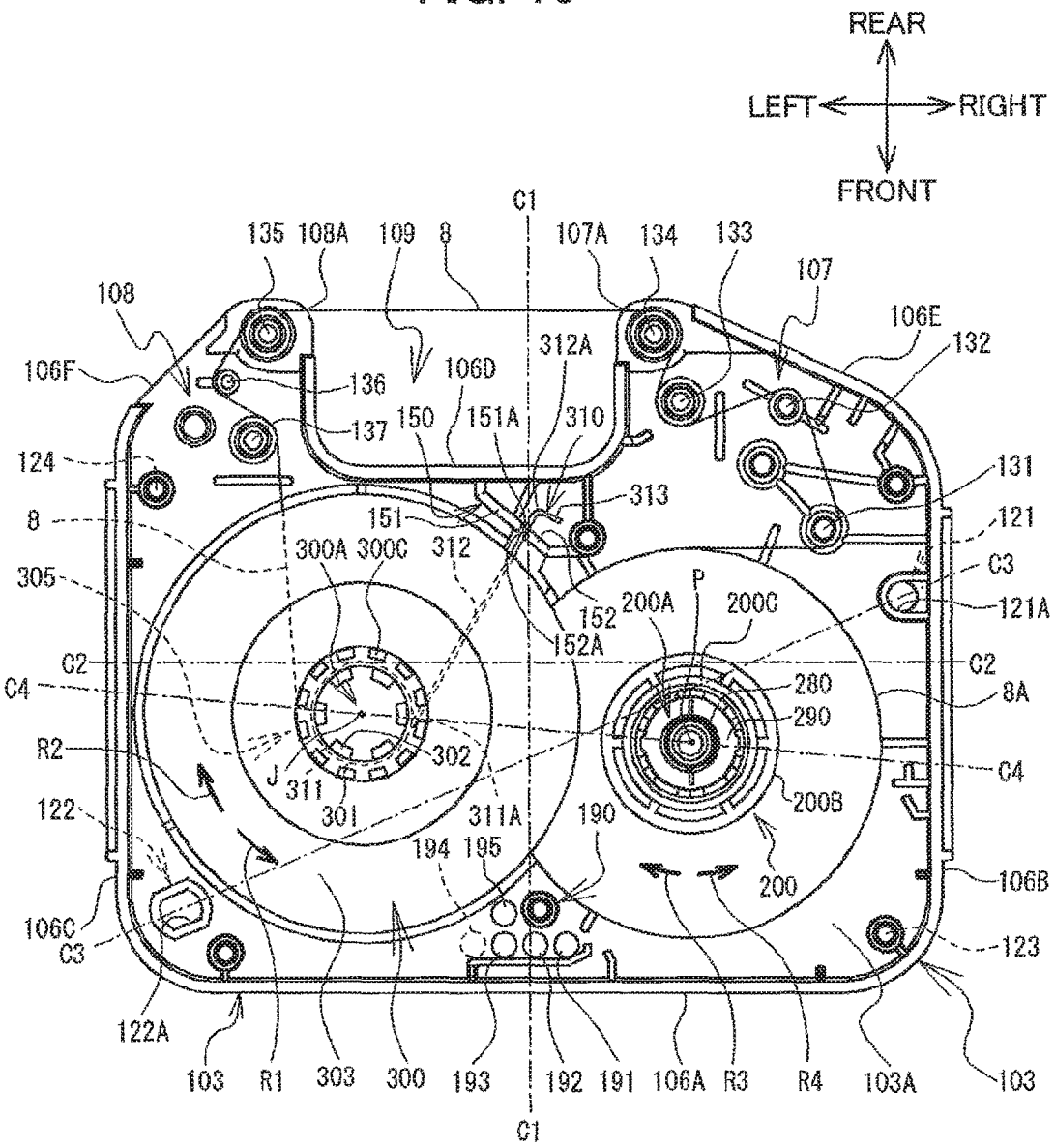
FIG. 10 is a plan view of a lower case 103.

As illustrated in FIGS. 4 and 10, the ink ribbon 8 is accommodated in the case 101 with its widthwise direction (transverse direction) oriented to be approximately parallel to the vertical direction. The ribbon spool 200 and take-up spool 300 are provided inside the case 101. With its widthwise direction oriented substantially parallel to the vertical direction, the ink ribbon 8 is conveyed from the ribbon spool 200 to the take-up spool 300 along a prescribed conveying path (hereinafter referred to as a ribbon-conveying path). The direction in which the ink ribbon 8 is conveyed along the ribbon-conveying path will be referred to as a ribbon-conveying direction. The ribbon spool 200 is a cylindrical member that is elongated vertically. One longitudinal end of the ink ribbon 8 (i.e., the upstream end in the ribbon-conveying direction) is wound about the ribbon spool 200. The take-up spool 300 is a cylindrical member that is elongated vertically. The other longitudinal end of the ink ribbon 8 (i.e., the downstream end in the ribbon-conveying direction) is connected to the take-up spool 300.

A mounting hole 200A is provided in the ribbon spool 200 and penetrates the interior of the ribbon spool 200 vertically. The outer circumferential surface of the ribbon spool 200 is a supply surface 200B around which unused ink ribbon 8 is wound. Specifically, the unused ink ribbon 8 is wound around the supply surface 200B such that, of the two surfaces possessed by the ink ribbon 8, an ink surface to which ink is applied faces inward. The upper limit quantity of the ink ribbon 8 can be wound around the supply surface 200B on the ribbon spool 200. In the following description, the ink ribbon 8 that is wound around the supply surface 200B will be referred to as a first ribbon roll 8A. The outer diameter of the first ribbon roll 8A is a maximum value when the upper limit quantity of ink ribbon 8 is wound around the supply surface 200B. The upper limit quantity of ink ribbon 8 wound around the ribbon spool 200 will be referred to as the first ribbon roll 8A at maximum diameter.

Protruding parts 200C and 200D are respectively provided on the upper side and lower side of the ribbon spool 200. The protruding part 200C protrudes upward from the supply surface 200B, and the protruding part 200D protrudes downward from the supply surface 200B. A support part 140 (see FIG. 11) is provided on an inner surface 102A of the upper case 102. The support part 140 opposes the second support hole 112 vertically. The protruding part 200C is mounted into the support part 140 from below and is rotatably supported by the support part 140. The protruding part 200D is fitted into the second support hole 112 from above and is rotatably supported by the second support hole 112. In other words, the ribbon spool 200 is supported by the second support hole 112 and support part 140 so as to be freely rotatable. Hence, the axis P is substantially coincident with the center of the second support hole 112 in a plan view.

A cylindrical rotating member 290 is mounted on the top portion of the mounting hole 200A. A clutch spring 280 is wound about the rotating member 290. An end portion of the clutch spring 280 is anchored on the support part 140. The rotating member 290 can rotate together with the ribbon spool 200. The clutch spring 280 expands in diameter when the ribbon spool 200 rotates in a prescribed draw-out direction (in the present embodiment, the clockwise direction in a plan view; see an arrow R3 in FIG. 10). Accordingly, the clutch spring 280 applies a relatively small rotational load to the ribbon spool 200 via the rotating member 290. Rotational load is a load applied for deterring rotation of a member. Rotational load applies torque to the ribbon spool 200. The torque generated by this load is stable and does not change according to the size of the outer diameter of the first ribbon roll 8A.

On the other hand, the clutch spring 280 contracts in diameter when the ribbon spool 200 rotates in a direction opposite the draw-out direction (see an arrow R4 in FIG. 10). Accordingly, the clutch spring 280 applies a relative large rotational load to the ribbon spool 200 via the rotating member 290. In other words, the rotating member 290 allows the ribbon spool 200 to rotate stably in the draw-out direction and restrains the ribbon spool 200 from rotating in the direction opposite the draw-out direction because of the elastic force of the clutch spring 280.

The take-up spool 300 includes a main body 301, a plurality of engaging protrusions 302, an upper support plate 303, a lower support plate 304, and the like. The main body 301 is a hollow cylindrical body that is elongated vertically. A mounting hole 300A is provided in the main body 301, penetrating the center portion of the main body 301 vertically. The engaging protrusions 302 all protrude toward the axis J from the inner circumferential surface of the main body 301. The engaging protrusions 302 are arranged radially and at regular intervals about the axis J.

The outer circumferential surface of the main body 301 constitutes a take-up surface 300B. Used ink ribbon 8 is wound around the take-up surface 300B. Specifically, the used ink ribbon 8 is wound around the take-up surface 300B in the take-up direction (indicated by an arrow R1) such that the ink surface among the two surfaces possessed by the ink ribbon 8 is on the outside. The upper limit quantity of ink ribbon 8 can be wound around the take-up surface 300B in this take-up spool 300. In the following description, the ink ribbon 8 wound around the take-up surface 300B will be referred to as a second ribbon roll 8B (see FIG. 3). The outer diameter of the second ribbon roll 8B is a maximum value when the upper limit quantity of ink ribbon 8 is wound around the take-up surface 300B. The upper limit quantity of ink ribbon 8 wound around the take-up spool 300 will be referred to as the second ribbon roll 8B at maximum diameter.

The upper support plate 303 is disc-shaped and extends radially outward from near the top end of the main body 301. The lower support plate 304 is disc-shaped and extends radially outward from near the bottom end of the main body 301. The upper support plate 303 and lower support plate 304 are plate-shaped members having the same diameter, and are arranged to oppose each other vertically. The distance between the upper support plate 303 and lower support plate 304 in the vertical direction is slightly larger than the length of the ink ribbon 8 in the widthwise direction. With this structure, the second ribbon roll 8B can be retained between the upper support plate 303 and lower support plate 304. A region surrounded by the upper support plate 303, lower support plate 304, and take-up surface 300B is an accommodating section 305 that can accommodate the second ribbon roll 8B. The outer diameter of the accommodating section 305 (i.e., respective outer diameters of the upper support plate 303 and lower support plate 304) is larger than the outer diameter of the second ribbon roll 8B at maximum diameter.

In the present embodiment, the upper support plate 303 is above the supply surface 200B, while the lower support plate 304 is below the supply surface 200B. The right edges of the upper support plate 303 and lower support plate 304 are located between the centerline C1 and the ribbon spool 200. That is, the accommodating section 305 is near the left side of the supply surface 200B. When a prescribed quantity or more of the ink ribbon 8 is wound around the supply surface 200B, a portion of the first ribbon roll 8A enters the accommodating section 305 from the right side thereof. In other words, when the radius of the first ribbon roll 8A exceeds the distance from the axis P to the accommodating section 305, a portion of the first ribbon roll 8A is positioned in the accommodating section 305.

When the outer diameter of the first ribbon roll 8A is larger than a prescribed length in this way, a portion of the first ribbon roll 8A is accommodated in the accommodating section 305. Since the ribbon spool 200 and take-up spool 300 can be positioned in closer proximity to each other, the case 101 can be made more compact. As the ink ribbon 8 is conveyed, the outer diameter of the second ribbon roll 8B increases, while the outer diameter of the first ribbon roll 8A decreases. Accordingly, interference between the first ribbon roll 8A and second ribbon roll 8B can be avoided.

Protruding parts 300C and 300D are respectively provided on the top side and bottom side of the take-up spool 300. The protruding part 300C protrudes farther upward than the upper support plate 303, and the protruding part 300D protrudes farther downward than the lower support plate 304. The protruding part 300C is fitted into the upper hole 111A from below and is rotatably supported in the upper hole 111A. The protruding part 300D is fitted into the lower hole 111B from above and is rotatably supported in the lower hole 111B. In other words, the take-up spool 300 is supported by the first support hole 111 so as to be freely rotatable. Hence, the axis J is substantially coincident with the center of the first support hole 111 in a plan view.

Figure 12:
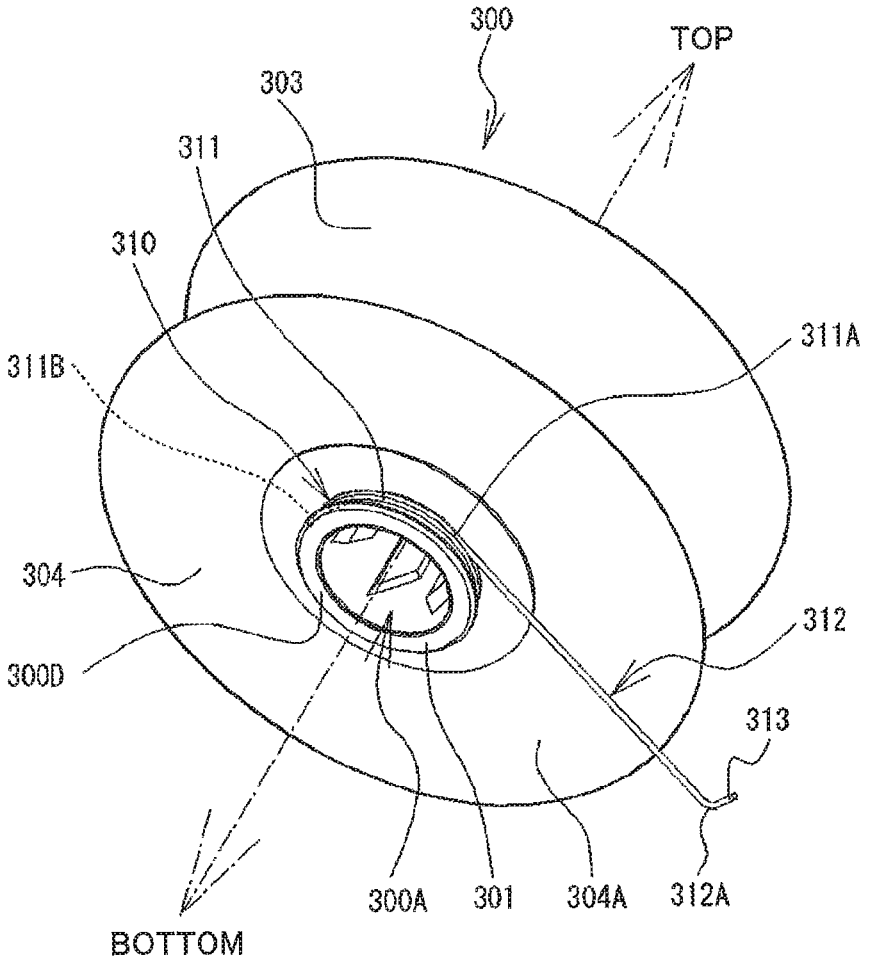
FIG. 12 is a perspective view of a take-up spool 300 and a clutch spring 310 as viewed from below thereof.

As shown in FIGS. 10 and 12, a metal clutch spring 310 is provided on the bottom side of the lower support plate 304. The clutch spring 310 is a spring member that returns the ink ribbon 8 in a slackened state to a state in which suitable tension is applied. The clutch spring 310 has a coil-like winding part 311, and an extension part 312 that extends outward from a top edge 311A of the winding part 311.

The winding part 311 extends from the top edge 311A of the winding part 311 to a bottom edge 311B of the winding part 311 in a direction opposite the take-up direction (i.e., the reverse direction indicated by an arrow R2) and is wound a plurality of turns (three turns in the present example) over the outer circumferential surface of the protruding part 300D. The top edge 311A of the winding part 311 contacts a bottom surface 304A of the lower support plate 304. The bottom edge 311B of the winding part 311 is positioned below the top edge 311A of the winding part 311 (i.e., in a direction away from the lower support plate 304). The extension part 312 extends linearly along the lower support plate 304 in a tangential direction from the top edge 311A of the winding part 311 to a point near the head peripheral surface 106D (i.e., a position separated farther from the axis J than an engaging part 150 described later is in a plan view). A portion of the extension part 312 extending from the top edge 311A of the winding part 311 to a position inside the outer peripheral edge of the lower support plate 304 contacts the bottom surface 304A of the lower support plate 304. A portion of the extension part 312 near its distal end 312A engages with the engaging part 150 (described later) provided on the case 101. The extension part 312 has an anchoring part 313 that extends from the distal end 312A of the extension part 312 in a direction away from the axis J with respect to the top edge 311A of the winding part 311. The anchoring part 313 suppresses the clutch spring 310 from coming out of the engaging part 150 (described later) in the extended direction of the extension part 312.

The winding part 311 expands in diameter when the take-up spool 300 rotates in the take-up direction (the direction indicated by arrow R1), thereby applying a relatively small rotational load to the take-up spool 300. On the other hand, the winding part 311 contracts in diameter when the take-up spool 300 rotates in the reverse direction, thereby applying a relatively large rotational load to the take-up spool 300. In other words, the clutch spring 310 allows the take-up spool 300 to rotate stably in the take-up direction and restrains the take-up spool 300 from rotating in the reverse direction due to its elastic force.

As shown in FIG. 10, the engaging part 150 and a plurality of bending parts 131-137 are provided inside the case 101. The engaging part 150 is a member that functions to restrict the clutch spring 310 from moving in the take-up direction and reverse direction. The engaging part 150 is disposed in the vicinity of the centerline C1 and the head peripheral surface 106D in a plan view. That is, the engaging part 150 is provided between the axis J and axis P and on the rear side of the connecting line C4 in a plan view. The distance from the top edge 311A of the winding part 311 to the engaging part 150 is shorter than the distance from the top edge 311A of the winding part 311 to the distal end 312A of the extension part 312 and greater than the distance from the distal end 312A of the extension part 312 to the engaging part 150. In other words, the engaging part 150 is provided at a position between the top edge 311A of the winding part 311 and distal end 312A of the extension part 312 that is closer to the distal end 312A in a plan view. The distance from the axis P to the engaging part 150 is greater than the radius of the first ribbon roll 8A at maximum diameter. That is, the engaging part 150 is disposed at a position separated from the axis P more than the largest circumference of the first ribbon roll 8A at maximum diameter in a plan view. The distance from the axis J to the engaging part 150 is greater than the radius of the second ribbon roll 8B at maximum diameter. That is, the engaging part 150 is provided at a position separated from the axis J farther than the largest circumference of the second ribbon roll 8B at maximum diameter in a plan view. The engaging part 150 includes a first engaging part 151, and a second engaging part 152.

The first engaging part 151 is arranged upright on an inner surface 103A of the lower case 103 near the head peripheral surface 106D and slightly leftward of the centerline C1. The first engaging part 151 is a plate-shaped member that extends both upward and in a direction toward the right front. The second engaging part 152 is arranged upright on the inner surface 103A of the lower case 103 at a position slightly separated from the first engaging part 151 toward the right-front. The second engaging part 152 is a plate-shaped member that extends both upward and in the direction toward the right front. The first engaging part 151 and second engaging part 152 oppose each other from opposing sides of the extension part 312. Hereinafter, opposing surfaces of the first engaging part 151 and second engaging part 152 will be called a first opposing surface 151A and a second opposing surface 152A, respectively.

The first engaging part 151 restricts the extension part 312 from moving in the take-up direction when the extension part 312 contacts the first opposing surface 151A. Similarly, the second engaging part 152 restricts the extension part 312 from moving in the reverse direction when the extension part 312 contacts the second opposing surface 152A.

The bending parts 131-137 are members used to establish the meandering ribbon-conveying path. Each of the bending parts 131-137 is arranged upright on the inner surface 103A of the lower case 103 and extends upward to the upper case 102. The bending parts 131, 132, and 136 are columnar members that are fixed to the lower case 103. Specifically, the bending parts 131, 132, and 136 are integrally formed with the lower case 103. The bending parts 133-135 and 137 are hollow cylindrically shaped rotating bodies capable of rotating about respective axes oriented vertically.

The bending parts 131-134 are disposed in the right-rear portion of the case 101. The bending part 131 is positioned on the right-rear side of the second support hole 112 (see FIG. 9) in a plan view. The positioning hole 121 is positioned between the bending part 131 and the ribbon spool 200 in the front-rear direction. The bending part 131 is positioned between the positioning hole 121 and the ribbon spool 200 in the left-right direction. The bending part 131 is positioned between the head peripheral surface 106D and the ribbon spool 200 in the front-rear direction. The distance from the axis P to the bending part 131 is greater than the radius of the first ribbon roll 8A at maximum diameter. The bending parts 132-134 are positioned in the first guide part 107. The bending part 132 is on the left-rear side of the bending part 131. The bending part 133 is on the left side of the bending part 132. The bending part 134 is on the left-rear side of the bending part 133 and in the left-rear portion of the first guide part 107.

The bending parts 135-137 are disposed in the left-rear portion of the case 101. The bending parts 135-137 are positioned in the second guide part 108. The bending part 137 is on the left-rear side of the first support hole 111 (see FIG. 8). The distance from the axis J to the bending part 137 is greater than the radius of the second ribbon roll 8B at maximum diameter (see FIG. 3). The bending part 136 is on the left-rear side of the bending part 137. The bending part 135 is on the right-rear side of the bending part 136 and in the right-rear portion of the second guide part 108.

Figure 11:
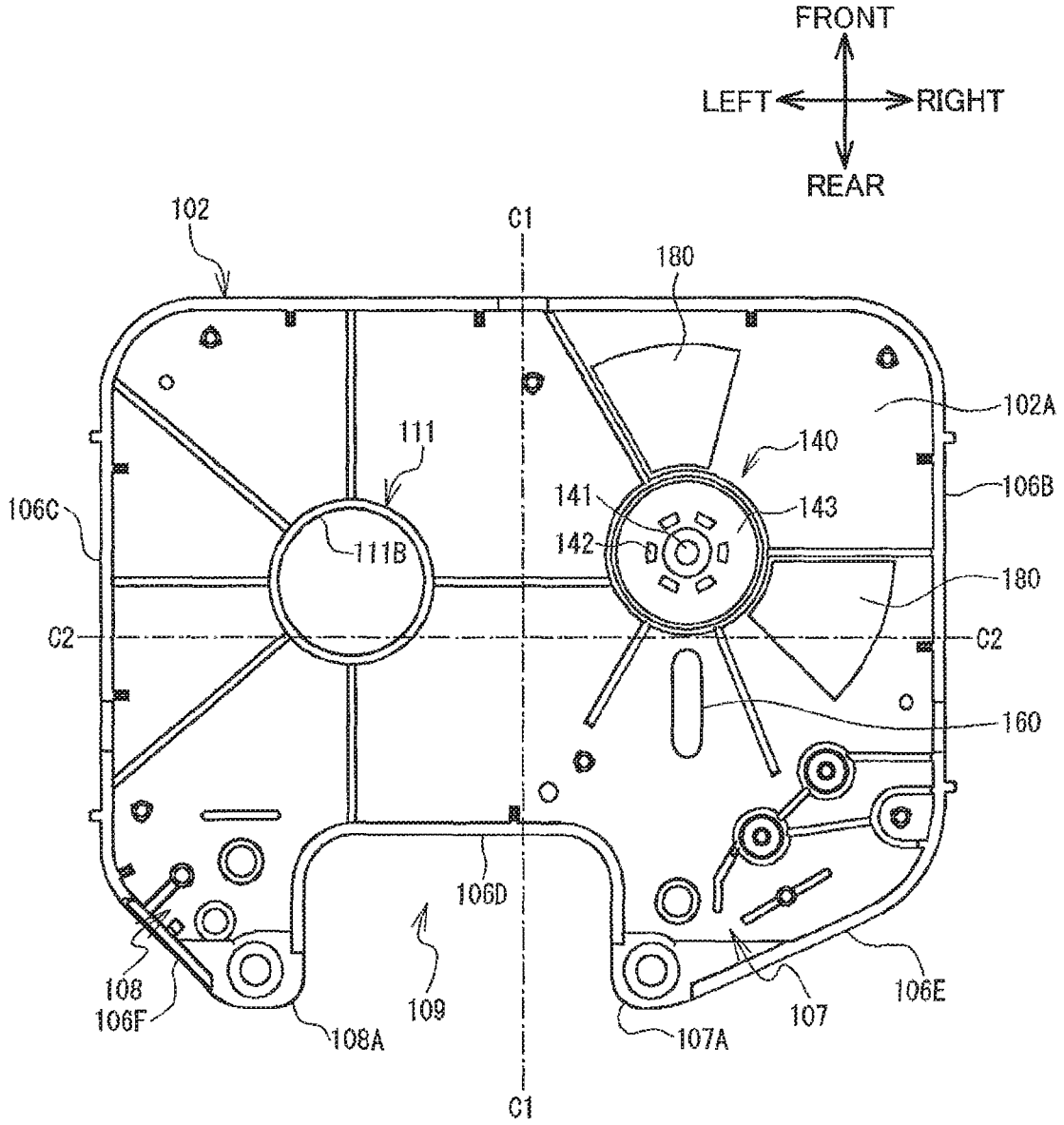
FIG. 11 is a bottom view of an upper case 102.

As illustrated in FIGS. 8 and 11, a window part 160 and at least one elastic body 180 are disposed in the upper case 102 around the support part 140. The window part 160 is an elongate hole that penetrates the upper case 102 vertically and extends in a radial direction relative to the support part 140. The window part 160 in the present embodiment extends rearward from the rear side of the support part 140. The rear end of the window part 160 is located on the outside of the first ribbon roll 8A at maximum diameter in a plan view. The user can discern the remaining quantity of the unused ink ribbon 8 by visually inspecting the position of the outer diameter of the first ribbon roll 8A through the window part 160.

Each elastic body 180 is a plate-shaped sponge disposed on the inner surface 102A of the upper case 102. Each elastic body 180 extends in a radial direction centered on the support part 140. In a plan view, each elastic body 180 extends from the outer edge of the support part 140 to a position outside the first ribbon roll 8A at maximum diameter. As illustrated in FIG. 4, the elastic bodies 180 elastically contact the first ribbon roll 8A from above on the inside of the case 101. That is, the elastic bodies 180 contact the top surface of the first ribbon roll 8A across the entire first ribbon roll 8A in a radial direction thereof and urge the first ribbon roll 8A downward. In the present embodiment, two elastic bodies 180 are disposed respectively on the front side and the right-rear side of the support part 140. The elastic bodies 180 are identical plate-shaped sponges formed in a sector shape with a thickness of 4 mm and are affixed to the inner surface 102A of the upper case 102 with double-sided adhesive tapes not illustrated in the drawings. When elastically contacting the first ribbon roll 8A, the elastic bodies 180 have a thickness of approximately 2 mm.

3. Operation Modes of the Printing Device 1 and Ribbon Cassette 100

Operation modes of the printing device 1 and ribbon cassette 100 will be described while referring to FIGS. 2 through 4, 9, and 10. In the printing device 1, the movable conveying roller 62 is displaced to the retracted position along with the opening of the cover 12. When the ribbon cassette 100 is mounted in the ribbon mounting section 30, the print head 61 is inserted into the head insertion section 109. The ribbon take-up shaft 63 is inserted through the lower hole 111B into the mounting hole 300A formed in the take-up spool 300. The plurality of protruding pieces 63A engages with the engaging protrusions 302. The rotatable detection shaft 71 is inserted through the second support hole 112 into the mounting hole 200A of the ribbon spool 200. As with the protruding pieces 63A, the plurality of protruding pieces 71A engages with the ribbon spool 200 in the mounting hole 200A.

The ribbon cassette 100 mounted in the ribbon mounting section 30 is placed in its proper position in the ribbon mounting section 30 as described below. The positioning pins 31 and 32 and the support pins 33 and 34 are inserted into the corresponding positioning holes 121 and 122 and pin holes 123 and 124, respectively. The top end of the support pin 33 contacts the top surface of the pin hole 123 to fix the vertical position of the ribbon cassette 100. The top end of the support pin 34 contacts the top surface of the pin hole 124 to fix the vertical position of the ribbon cassette 100. The top end of the positioning pin 31 is fitted tightly into the anchoring part 121A to fix the position of the ribbon cassette 100 in each of the up-down, left-right, and front-rear directions. The top end of the positioning pin 32 is fitted tightly into the anchoring part 122A to fix the position of the ribbon cassette 100 in each of the up-down, left-right, and front-rear directions. The support part 35 supports the front recessed part 125 from below to fix the vertical position of the ribbon cassette 100.

When the front recessed part 125 is supported by the support part 35, the five detection switches 81 are selectively pressed by the type indicating part 190. In the present embodiment, each of the indicators 191-195 respectively confronts one of the five detection switches 81. The detection switches 81 that confront the indicators 191-193 and 195 are inserted into the hole parts and held at the reference position. The switch 81 confronting the indicator 194 is pressed by the surface part and displaced to the depressed position.

The indicator detection unit 80 outputs a combination of OFF signals corresponding to the detection switches 81 in the reference position, and ON signals corresponding to the detection switches 81 in the depressed position to the CPU 41 (see FIG. 6) as the type detection pattern. The CPU 41 identifies the ribbon type corresponding to the type detection pattern received from the indicator detection unit 80 by referencing the table in the flash memory 45 (see FIG. 6). In this way, the printing device 1 can identify the ribbon type in the ribbon cassette 100 that is mounted in the ribbon mounting section 30.

The cover 12 is closed with the ribbon cassette 100 mounted in the ribbon mounting section 30 and the tube 9 mounted in the tube mounting section 40. When the cover 12 is closed, the movable conveying roller 62 is displaced to the operating position. The movable conveying roller 62 places the tube 9 in the tube mounting section 40 over the unused ink ribbon 8 and urges both the tube 9 and the ink ribbon 8 against the print head 61. At this time, the tube 9 elastically deforms by the urging force of the movable conveying roller 62 and establishes surface contact with the print head 61 through the ink ribbon 8.

When a print start command is inputted through the keyboard 7 or the operating section 17, the CPU 41 drives the conveying motor 64 to rotate the movable conveying roller 62 and ribbon take-up shaft 63. The tube 9 in the tube mounting section 40 is fed downstream in the tube-feeding direction along with the rotation of the movable conveying roller 62. At this time, the unprinted tube 9 present outside the housing 10 is drawn into the tube mounting section 40 through the tube insertion opening 15.

Along with the rotation of the ribbon take-up shaft 63, the take-up spool 300 rotates in the take-up direction (the direction of the arrow R1). At this time, the winding part 311 expands in diameter. The ribbon spool 200 rotates in the draw-out direction (the direction of the arrow R3) along with the rotation of the take-up spool 300. In this way, the ink ribbon 8 is pulled off the first ribbon roll 8A near the rear side thereof and is conveyed along the following ribbon-conveying path. As described above, when the ribbon spool 200 rotates in the draw-out direction, the elastic force of the clutch spring 280 applies a relatively small rotational load to the ribbon spool 200. Through this load, a suitable tension is applied to the ink ribbon 8 being conveyed, reducing the potential for slack occurring in the ink ribbon 8.

After being pulled off the first ribbon roll 8A, the unused ink ribbon 8 passes sequentially over the right-front surface of the bending part 131, the right-rear surface of the bending part 132, the left-front surface of the bending part 133, and the right-rear surface of the bending part 134. Subsequently, the unused ink ribbon 8 is discharged from the case 101 through the ribbon outlet 107A and advances leftward through the head insertion section 109. At this time, the unused ink ribbon 8 passes between the tube 9 and print head 61.

The CPU 41 drives the print head 61 for heating the ink ribbon 8 passing between the tube 9 and print head 61 to print characters on the tube 9. In the present embodiment, the print head 61 prints characters as a normal image on the front side of the tube 9 passing over the rear side of the print head 61. Subsequently, the CPU 41 drives the cutting motor 93 to cut the printed tube 9 by moving the cutting blade 92 toward the receiving plate 91. The cut section of the tube 9 is discharged out of the housing 10 through the tube discharge opening 16.

The used ink ribbon 8 advances into the case 101 through the ribbon inlet 108A and passes over the left-rear surface of the bending part 135, the left surface of the bending part 136, and the right-rear surface of the bending part 137. Finally, the used ink ribbon 8 is taken up on the take-up spool 300 at the left side thereof and retained as the second ribbon roll 8B. In this way, the ink ribbon 8 is conveyed along the meandering ribbon-conveying path by passing over the plurality of bending parts 131-137. At this time, sliding friction is generated between the ink ribbon 8 being conveyed and respective one of the plurality of bending parts 131-137. A suitable conveying load is applied to the ink ribbon 8 being conveyed along the ribbon-conveying path. The conveying load is applied for deterring conveyance of the ink ribbon 8. Since a suitable tension is applied to the conveyed ink ribbon 8, slack is further unlikely to be produced in the ink ribbon 8.

The two elastic bodies 180 elastically contact the first ribbon roll 8A in a direction along the axis P. When the unused ink ribbon 8 is pulled from the first ribbon roll 8A, sliding friction is generated between the rotating first ribbon roll 8A and each of the elastic bodies 180. This sliding friction applies a suitable rotational load to the first ribbon roll 8A so that a suitable conveying load is applied to the ink ribbon 8 being pulled from the first ribbon roll 8A. Since a suitable tension is applied to the ink ribbon 8 being conveyed, slack is less likely to occur in the ink ribbon 8.

In the present embodiment, the two elastic bodies 180 are disposed at positions that do not overlap the upper support plate 303 (see FIGS. 4 and 10) in a plan view. This arrangement can prevent interference between the take-up spool 300 and the elastic bodies 180. The two elastic bodies 180 are disposed at different positions from the window part 160, thereby preventing the elastic bodies 180 from blocking the window part 160. The two elastic bodies 180 elastically contact the first ribbon roll 8A at different positions from each other in the circumferential direction. This arrangement ensures that a more suitable rotational load is applied over the entire first ribbon roll 8A than when the elastic bodies 180 elastically contact the first ribbon roll 8A disproportionately in one portion of the first ribbon roll 8A. Since the elastic bodies 180 are identical to each other, manufacturing the elastic bodies 180 is simplified.

When the outer diameter of the first ribbon roll 8A is at its minimum state, the first ribbon roll 8A is in danger of being bent in the widthwise direction when the elastic bodies 180 elastically contact the first ribbon roll 8A. In the present embodiment, the two elastic bodies 180 are arranged in positions different from the ink ribbon 8 between the ribbon spool 200 and bending part 131 when the outer diameter of the first ribbon roll 8A is at its minimum state. When the outer diameter of the first ribbon roll 8A is at its minimum state, the elastic bodies 180 do not contact the first ribbon roll 8A. This arrangement allows the ink ribbon 8 being pulled off the first ribbon roll 8A to avoid being bent in the widthwise direction by the elastic force of the elastic bodies 180.

Note that the rotatable detection shaft 71 also rotates in the draw-out direction along with the rotation of the ribbon spool 200. At this time, the sensor 73 outputs ON signals and OFF signals to the CPU 41 in correspondence with the light-receiving unit 73B intermittently detecting light emitted from the light-emitting unit 73A. The CPU 41 identifies the conveyance amount of the ink ribbon 8 corresponding to the rotated amount of the rotatable detection shaft 71 during a printing operation on a basis of the inputted ON/OFF signals. In other words, the printing device 1 can identify the quantity of ink ribbon 8 used since the beginning of a printing operation.

4. Draw-Out Load

A draw-out load produced when the ink ribbon 8 is pulled will be described. The draw-out load is a load applied to the ink ribbon 8 for restraining the ink ribbon 8 from being pulled out of the case 101. A first draw-out load is applied to the ink ribbon 8 while the ink ribbon 8 is pulled through the ribbon outlet 107A from the ribbon spool 200 side. The first draw-out load is a sum of all draw-out loads applied to the ink ribbon 8 on the upstream side of the ribbon outlet 107A in the ribbon-conveying direction. Specifically, the first draw-out load in the present embodiment is the sum of draw-out load generated by the sliding friction between the ink ribbon 8 and the bending parts 131-134 disposed on the upstream side of the ribbon outlet 107A in the ribbon-conveying direction; draw-out load produced by rotational load that the elastic force of the clutch spring 280 applies to the ribbon spool 200; draw-out load generated by sliding friction between the first ribbon roll 8A and the elastic bodies 180; and the like. More specifically, in addition to the draw-out loads described above, the first draw-out load includes draw-out load generated by sliding friction between the ribbon spool 200 and the case 101; draw-out load generated by sliding friction between layers of the ink ribbon 8 in the first ribbon roll 8A; and draw-out load generated by sliding friction between the first ribbon roll 8A and the inner surface 103A of the lower case 103.

On the other hand, a second draw-out load is applied to the ink ribbon 8 when the ink ribbon 8 is pulled through the ribbon inlet 108A from the take-up spool 300 side. The second draw-out load is a sum of draw-out loads applied to the ink ribbon 8 on the downstream side of the ribbon inlet 108A in the ribbon-conveying direction. Specifically, the second draw-out load in the present embodiment is the sum of draw-out load generated by sliding friction between the ink ribbon 8 and the bending parts 135-137 provided on the downstream side of the ribbon inlet 108A in the ribbon-conveying direction; draw-out load produced by rotational load that the elastic force of the clutch spring 310 applies to the take-up spool 300; and the like. More specifically, in addition to the draw-out loads described above, the second draw-out load includes draw-out load generated by sliding friction between the take-up spool 300 and the case 101; draw-out load generated by sliding friction between the second ribbon roll 8B and the upper support plate 303 or lower support plate 304; and draw-out load generated by sliding friction between layers of the ink ribbon 8 in the second ribbon roll 8B.

In the ribbon cassette 100, the material of the clutch spring 310, the length of the extension part 312, the number of turns, diameter, and the like of the winding part 311 are selected and the position of the second engaging part 152 (i.e., the distance between the second engaging part 152 and the top edge 311A of the winding part 311) is set so that the second draw-out load is smaller than the first draw-out load. In this way, if an external load in a direction perpendicular to the ink surface of the ink ribbon 8 is applied to the ink ribbon 8 exposed from the case 101 between the ribbon outlet 107A and ribbon inlet 108A, for example, the ink ribbon 8 is drawn out from the take-up spool 300 side through the ribbon inlet 108A. That is, the ink ribbon 8 is pulled off the second ribbon roll 8B, which is the used ink ribbon 8, rather than off the first ribbon roll 8A, which is the unused ink ribbon 8.

5. Operation Modes of the Clutch Spring 310

Operation modes of the clutch spring 310 will be described in detail with reference to FIGS. 10 and 13. When an external force is applied to the take-up spool 300 for rotating the take-up spool 300 in the take-up direction (the direction indicated by arrow R1), such as during a printing operation, the clutch spring 310 rotates in the take-up direction together with the take-up spool 300. When the clutch spring 310 rotates in the take-up direction, the extension part 312 contacts the first opposing surface 151A and is restricted by the first opposing surface 151A from moving farther in the take-up direction. Consequently, the winding part 311 expands in diameter. Therefore, since only a relatively small rotational load is applied to the take-up spool 300, the take-up spool 300 rotates stably in the take-up direction. Note that the expanded winding part 311 returns to its state prior to expanding (see FIG. 10) when the take-up spool 300 stops rotating in the take-up direction.

Figure 13:
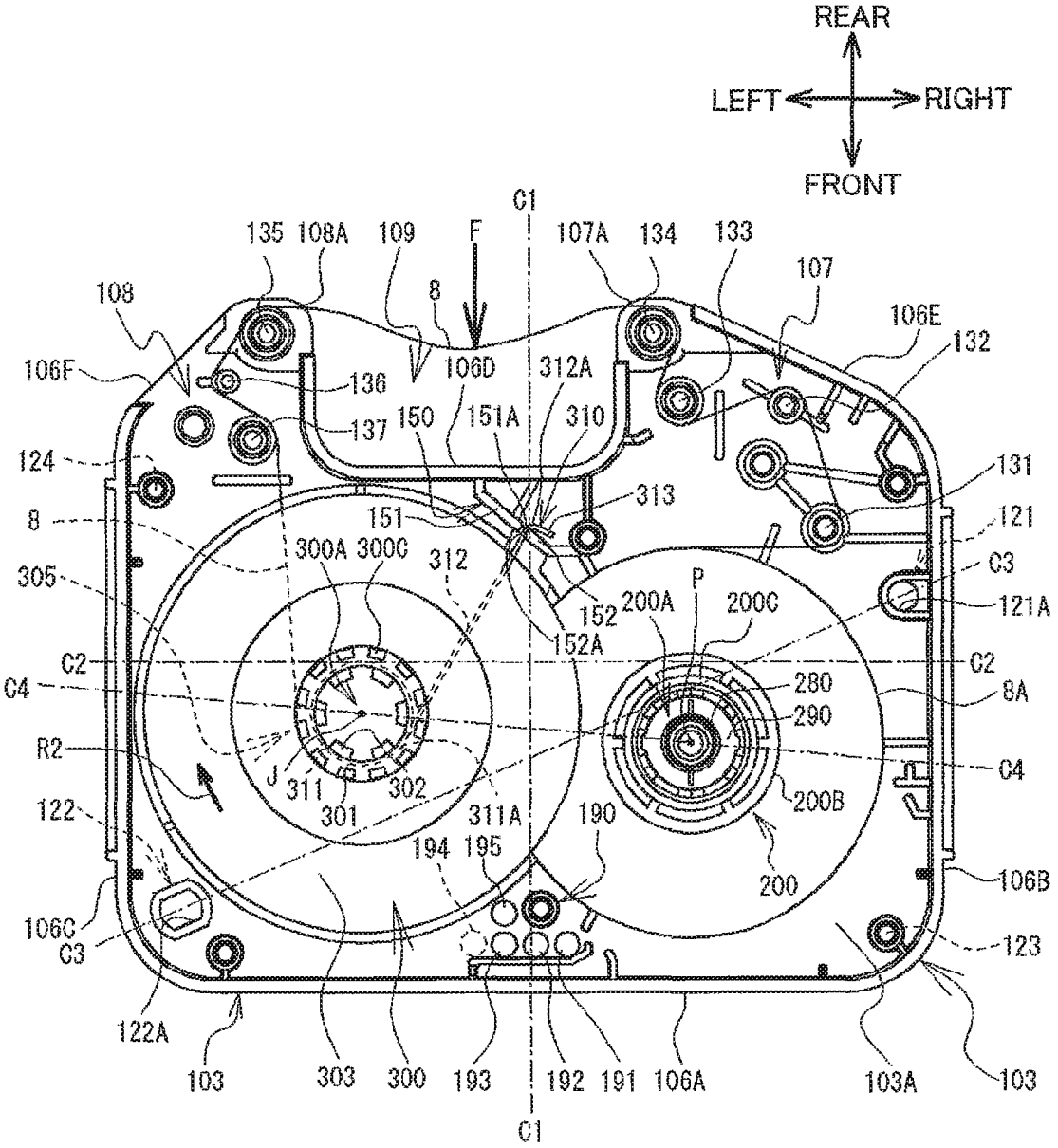
FIG. 13 is a plan view of the lower case 103 when an external force F is applied to an ink ribbon 8.

Further, as illustrated in FIG. 13, when an external force F of a prescribed magnitude is applied to the ink ribbon 8 from the rear side, for example, a force is applied to the take-up spool 300 for rotating the take-up spool 300 in the reverse direction (the direction indicated by arrow R2) and a force is applied to the ribbon spool 200 for rotating the ribbon spool 200 in the draw-out direction (the direction indicated by arrow R3). Since the second draw-out load is smaller than the first draw-out load in this case, the take-up spool 300 rotates in the reverse direction. The clutch spring 310 rotates in the reverse direction together with the take-up spool 300.

When the clutch spring 310 rotates in the reverse direction, the extension part 312 contacts the second opposing surface 152A and is restricted by the second opposing surface 152A from moving farther in the reverse direction. Consequently, the winding part 311 contracts in diameter while the extension part 312 elastically deforms about its contact point with the second opposing surface 152A. In other words, the portion of the extension part 312 near the top edge 311A of the winding part 311 begins to wrap around the outer circumferential surface of the protruding part 300D. At this time, the anchoring part 313, which is separated from the second engaging part 152 in a plan view, moves to a position for contacting the second engaging part 152. In other words, by wrapping the extension part 312 around the outer circumferential surface of the protruding part 300D, the anchoring part 313 can move from a separated position separated from the engaging part 150 to a contact position contacting the engaging part 150 while remaining farther separated from the axis J than the engaging part 150. Through this action, the take-up spool 300 rotates in the reverse direction an amount equivalent to the degree of elastic deformation in the extension part 312. Note that the anchoring part 313 may simply approach the second engaging part 152 without contacting the same if the external force F is smaller than the prescribed magnitude.

As described above, as the take-up spool 300 rotates in the reverse direction when the external force F is applied to the ink ribbon 8, the ink ribbon 8 is pulled through the ribbon inlet 108A from the second ribbon roll 8B side into a slackened state. That is, slack is generated in the ink ribbon 8 by the amount that the clutch spring 310 elastically deforms. If the external force F is released from the ink ribbon 8 at this time, the elastically deformed clutch spring 310 (see FIG. 13) returns to its shape prior to deformation (see FIG. 10), allowing the take-up spool 300 to rotate in the take-up direction. Consequently, the ink ribbon 8 in its slackened state (see FIG. 13) returns to a state in which suitable tension is applied thereto (see FIG. 10).

As described above, the winding part 311 in the present embodiment is wound from the top edge 311A of the winding part 311, from which the extension part 312 extends, in a direction (the direction indicated by the arrow R2) opposite the take-up direction (the direction indicated by the arrow R1) around the outer circumferential surface of the protruding part 300D constituting the take-up spool 300. With this configuration, the winding part 311 expands in diameter when the take-up spool 300 rotates in the take-up direction and contracts in diameter when the take-up spool 300 rotates in the reverse direction.

If an external force of a prescribed magnitude (the external force F, for example) is applied in the direction perpendicular to the ink surface of the ink ribbon 8 exposed from the case 101 between the ribbon outlet 107A and ribbon inlet 108A, for example, the take-up spool 300 rotates in the reverse direction since the second draw-out load is smaller than the first draw-out load. In this case, the clutch spring 310 rotates in the reverse direction along with the rotation of the take-up spool 300.

When the clutch spring 310 rotates in the reverse direction, the extension part 312 contacts the second opposing surface 152A and is restricted from moving farther in the reverse direction from the second opposing surface 152A. Consequently, the winding part 311 contracts in diameter and the extension part 312 elastically deforms about its contact point with the engaging part 150. In other words, the take-up spool 300 rotates in the reverse direction an amount equivalent to the degree that the extension part 312 elastically deforms. Hence, the external force of prescribed magnitude places the ink ribbon 8 in a slackened state by pulling the used ink ribbon 8 off the second ribbon roll 8B rather than the unused ink ribbon 8 off the first ribbon roll 8A. Accordingly, the ribbon cassette 100 can suppress an external force of prescribed magnitude from wastefully pulling out unused ink ribbon 8.

When the ink ribbon 8 is subsequently released from this external force of prescribed magnitude, the elastically deformed extension part 312 returns to its original state owing to its elasticity, and the winding part 311 expands in diameter. Consequently, the take-up spool 300 rotates in the take-up direction, taking up the slack in the ink ribbon 8, thereby returning the ink ribbon 8 to a state in which suitable tension is applied. Hence, the ribbon cassette 100 can return the slackened ink ribbon 8 to a state in which suitable tension is applied thereto.

The engaging part 150 is provided at a position separated from the axis J of the take-up spool 300 farther than the maximum outer circumference of the second ribbon roll 8B at maximum diameter. Therefore, the ribbon cassette 100 can prevent the second ribbon roll 8B and engaging part 150 from interfering with each other. Further, since the distance between the top edge 311A of the winding part 311 and the engaging part 150 can be made larger, the length of the extension part 312 can be made longer. Since a longer extension part 312 more readily deforms elastically, the ribbon cassette 100 can better return the ink ribbon 8 in a more slackened state to a state in which suitable tension is applied than if the extension part 312 were shorter.

The extension part 312 extends in the tangential direction from the top edge 311A of the winding part 311, thereby generating less load on the top edge 311A than if the extension part 312 were first bent and then extended from the top edge 311A of the winding part 311. Therefore, the elastically deformed clutch spring 310 is more readily returned by its elasticity to a shape in which the extension part 312 extends in its original form in the tangential direction to the top edge 311A of the winding part 311. Accordingly, the ribbon cassette 100 can suppress the clutch spring 310 from becoming deformed through repeated use.

The take-up spool 300 is provided with the lower support plate 304 that retains the second ribbon roll 8B on its top surface. The outer diameter of the lower support plate 304 is greater than the outer diameter of the second ribbon roll 8B at maximum diameter. The extension part 312 extends along the lower support plate 304 at a position opposite the second ribbon roll 8B with respect to the lower support plate 304. In this way, the lower support plate 304 can prevent the clutch spring 310 from contacting the ink ribbon 8 and impeding the take-up spool 300 in taking up the ink ribbon 8. The portion of the extension part 312 extending from the top edge 311A of the winding part 311 and positioned inward from the peripheral edge of the lower support plate 304 contacts the bottom surface 304A of the lower support plate 304, thereby suppressing the extension part 312 from deforming toward the lower support plate 304 side.

Among the edges of the winding part 311, the top edge 311A from which the extension part 312 extends is positioned closer to the lower support plate 304 than the bottom edge 311B (i.e., above the bottom edge 311B). In this way, the extension part 312 can extend along the bottom surface 304A of the lower support plate 304 while contacting the same, without being greatly deformed. Hence, the ribbon cassette 100 can suppress the extension part 312 from deforming vertically.

The extension part 312 has the anchoring part 313 that extends from the distal end 312A in a direction opposite to a direction toward the axis J from the top edge 311A of the winding part 311. In this case, when the take-up spool 300 rotates in the reverse direction, the anchoring part 313 contacts the second engaging part 152, thereby suppressing the extension part 312 from coming out of the engaging part 150.

The anchoring part 313 can move between the separated position separated from the engaging part 150 and the contact position contacting the engaging part 150 while remaining farther separated from the axis J than the engaging part 150. For example, if an external force of prescribed magnitude (the external force F, for example) is applied in the perpendicular direction to the ink surface of the ink ribbon 8 exposed from the case 101 between the ribbon outlet 107A and ribbon inlet 108A, the anchoring part 313 moves from the position separated from the engaging part 150 toward the position in contact with the engaging part 150 as the extension part 312 deforms elastically. In this case, slack can be generated in the ink ribbon 8 until the anchoring part 313 moves to the position in contact with the engaging part 150. Hence, the ribbon cassette 100 can return the ink ribbon 8 in a more slackened state to a state in which suitable tension is applied thereto.

In a plan view, the engaging part 150 is provided between the axis P and axis J, to the side of the connecting line C4 on which the ink ribbon 8 is exposed (i.e., the rear side), at a position farther separated from the axis P than the maximum circumference of the first ribbon roll 8A at maximum diameter is from the axis P, and at a position farther separated from the axis J than the maximum circumference of the second ribbon roll 8B at maximum diameter is from the axis J. In this case, the ribbon cassette 100 suppresses the first ribbon roll 8A and the second ribbon roll 8B from interfering with the engaging part 150.

In the described embodiment the case 101 is an example of a "cassette case" of the disclosure. The connecting surface 106E is an example of a "first outer wall" of the disclosure. The ribbon outlet 107A is an example of a "first hole" of the disclosure. The connecting surface 106F is an example of a "second outer wall" of the disclosure. The ribbon inlet 108A is an example of a "second hole" of the disclosure. The ribbon spool 200 is an example of a "first spool" of the disclosure. The take-up spool 300 is an example of a "second spool" of the disclosure. The take-up surface 300B is an example of a "first portion" of the disclosure. The protruding part 300D is an example of a "second portion" of the disclosure. The clutch spring 310 is an example of a "spring member" of the disclosure. The top edge 311A is an example of a "first end portion" of the disclosure. The bottom edge 311B is an example of a "second end portion" of the disclosure. The lower support plate 304 is an example of a "flange" of the disclosure. The anchoring part 313 is an example of an "anchoring part" of the disclosure.

The present disclosure is not limited to the embodiment described above but may be modified in various ways. For example, while the winding part 311 is wound a plurality of turns around the outer circumferential surface of the protruding part 300D in the embodiment described above, the winding part 311 may instead be wound one turn or less than one turn around the protruding part 300D. While the extension part 312 extends linearly from the top edge 311A of the winding part 311, the extension part 312 instead may include a bent portion in its extension or may curve while extending.

While the anchoring part 313 extends from the distal end 312A of the extension part 312 in the direction toward the opposite side of the top edge 311A of the winding part 311 from the axis J, the anchoring part 313 need only extend in a direction different from the extended direction of the extension part 312. In this case, the anchoring part 313 can still contact the engaging part 150 to prevent the extension part 312 from coming out of the engaging part 150.

While the engaging part 150 is arranged upright on the inner surface 103A of the lower case 103 in the embodiment described above, the present disclosure is not limited to this arrangement. For example, the engaging part 150 may be a through-hole that penetrates the lower case 103 vertically. The extension part 312 can engage with the engaging part 150 by being inserted into the through-hole. Since new members (the first engaging part 151 and second engaging part 152 in the depicted embodiment) are not provided as the engaging part 150 in this case, the ribbon cassette 100 can be maintained at a light weight.

The members that apply the first draw-out load and second draw-out load to the ink ribbon 8 are not limited to those described in the embodiment. For example, an elastic body may be provided between the inner surface 103A of the lower case 103 and the ink ribbon 8 for elastically contacting the ink ribbon 8. In this case, the ribbon cassette 100 can apply the first draw-out load to the ink ribbon 8 through sliding friction generated between the ink ribbon 8 and the elastic body.

While the clutch spring 310 is formed of metal in the embodiment described above, the clutch spring 310 is not necessarily limited to this material, provided that the second draw-out load is smaller than the first draw-out load. For example, the clutch spring 310 may be formed of a plastic material or a metal-plastic hybrid.

While the clutch spring 310 is provided on the protruding part 300D beneath the lower support plate 304 in the embodiment described above, but the clutch spring 310 may instead be provided on the protruding part 300C above the upper support plate 303. In this case, the upper support plate 303 corresponds to the "flange" of the disclosure. The engaging part 150 may be arranged upright on the inner surface 102A of the upper case 102. The extension part 312 may be extended from the bottom edge 311B of the winding part 311. In this case, the winding part 311 may be wound in the reverse direction from the bottom edge 311B to the top edge 311A.

While the draw-out direction is clockwise in a plan view in the embodiment described above, the draw-out direction may be counterclockwise in a plan view instead, and while the take-up direction is counterclockwise in a plan view, the take-up direction may be clockwise in a plan view instead. When the take-up direction is clockwise in a plan view, the winding part 311 should be wound counterclockwise in a plan view from the top edge 311A, from which the extension part 312 extends, to the bottom edge 311B.

While the ribbon cassette 100 is provided with the two elastic bodies 180 in the embodiment described above, the number, shape, position, and the like of elastic bodies that elastically contact the first ribbon roll 8A may be modified. The number, shape, position, and the like of elastic bodies that elastically contact the first ribbon roll 8A in the ribbon cassette 100 should be modified such that the second draw-out load is smaller than the first draw-out load. For example, the elastic bodies for elastically contacting the first ribbon roll 8A may be provided on the lower case 103 instead of the upper case 102. The elastic bodies for elastically contacting the first ribbon roll 8A may be provided on both the upper case 102 and lower case 103. In the latter case, the elastic bodies provided on the upper case 102 may be vertically symmetric or asymmetric to the elastic bodies provided on the lower case 103.

Figure 14A:
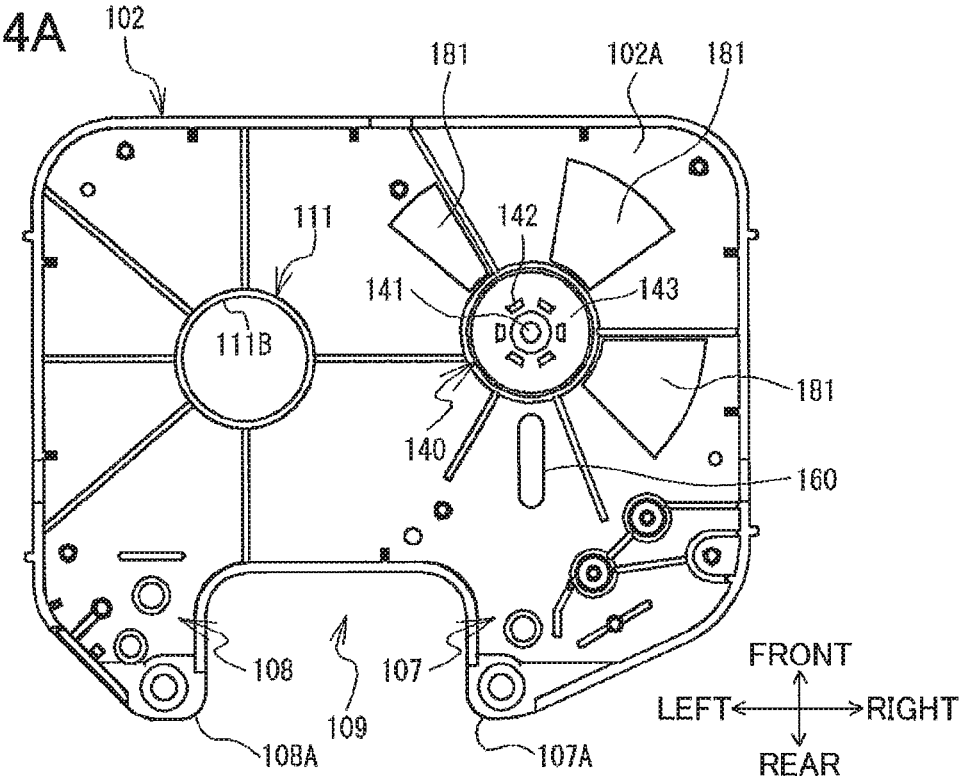
FIGS. 14A and 14B are bottom views illustrating variations of the upper case 102.

As illustrated in FIG. 14A, three elastic bodies 181 may be provided in place of the two elastic bodies 180. The three elastic bodies 181 are all plate-shaped sponges that are similar to the elastic bodies 180, but differ from the elastic bodies 180 in the following points. The three elastic bodies 181 are arranged on the left-front side, right-front side, and right-rear side of the support part 140. The three elastic bodies 181 are also varied in shape. The elastic body 181 positioned on the left-front side of the support part 140 has a sector shape with the smallest dimension in the circumferential direction among the three elastic bodies 181. The elastic body 181 positioned on the right-rear side of the support part 140 has a sector shape with the largest dimension in the circumferential direction among the three elastic bodies 181.

Figure 14B:
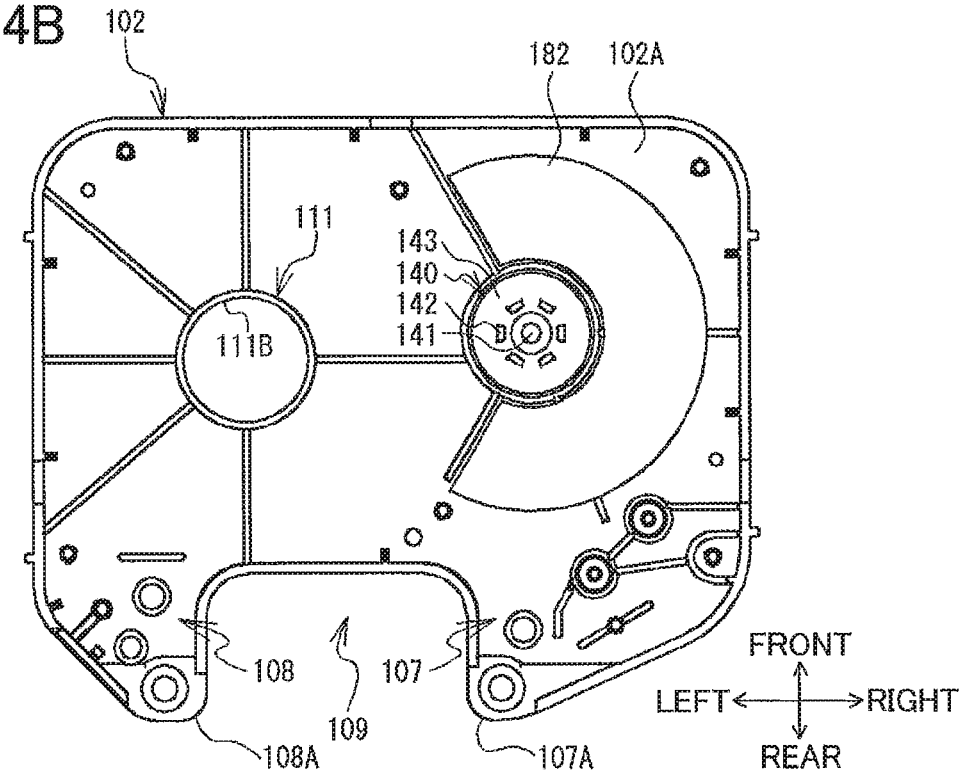

As illustrated in FIG. 14B, a single elastic body 182 may be provided in place of the two elastic bodies 180. In this case, the window part 160 is not provided. The elastic body 182 is a plate-shaped sponge similar to the elastic body 180, but differs from the elastic body 180 in the following point. The elastic body 182 has a sector shape that extends in the clockwise direction around the support part 140 in a bottom view from the left-front side to the left-rear side of the support part 140.

What is claimed is:

1. A ribbon cassette comprising:

a cassette case having a box shape;

an ink ribbon accommodated in the cassette case and having a portion exposed to an outside of the cassette case between a first hole formed in a first outer wall of the cassette case and a second hole formed in a second outer wall of the cassette case;

a first spool rotatably supported to the cassette case and having a hollow cylindrical shape, one end portion of the ink ribbon being wound on the first spool;

a second spool rotatably supported to the cassette case and having a hollow cylindrical shape, the second spool having a first portion to which another end portion of the ink ribbon is connected;

an engaging part provided in the cassette case; and a spring member wound around a second portion of the second spool, the second portion being different from the first portion, wherein the spring member includes a winding part wound around the second portion, and an extension part extending from a first end portion of the winding part and engaged with the engaging part;

wherein the winding part is wound, from the first end portion, in a winding direction opposite to a take-up direction of the second spool in which the ink ribbon is taken up by the second spool; and wherein a second draw-out load applied to the ink ribbon being pulled from the second spool through the second hole is smaller than a first draw-out load applied to the ink ribbon being pulled from the first spool through the first hole.

2. The ribbon cassette according to claim 1, wherein the extension part extends from the first end portion in a tangential direction at the first end portion.

3. The ribbon cassette according to claim 1, wherein the second spool comprises a flange configured to retain the taken up ink ribbon, the flange extending in a direction away from a rotation center of the second spool;

wherein the flange has a diameter greater than a diameter of the ink ribbon defined when the ink ribbon in its entirety is taken up by the second spool; and wherein the extension part has a portion extending along and in contact with the flange at a position opposite to the ink ribbon with respect to the flange.

4. The ribbon cassette according to claim 3, wherein the winding part has a second end portion opposite to the first end portion, the first end portion being closer to the flange than the second end portion is to the flange.

5. The ribbon cassette according to claim 1, wherein the extension part has a tip end portion from which an anchoring part extends in a predetermined direction different from an extending direction of the extension part.

6. The ribbon cassette according to claim 5, wherein the predetermined direction is opposite to a direction toward a rotation center of the second spool from the first end portion.

7. The ribbon cassette according to claim 5, wherein the anchoring part is positioned farther away from a rotation center of the second spool than the engaging part is from the rotation center of the second spool, the anchoring part being movable between a separated position separated from the engaging part and a contact position contacting with the engaging part.

8. The ribbon cassette according to claim 1, wherein the engaging part is positioned:

between a rotation center of the first spool and a rotation center of the second spool;

at a side on which the portion of the ink ribbon exposed to the outside is positioned with respect to an imaginary line connecting the rotation center of the first spool and the rotation center of the second spool;

to be separated farther from the rotation center of the first spool than a maximum outer circumference of the ink ribbon wound around the first spool is from the rotation center of the first spool, the maximum outer circumference being defined by winding the ink ribbon in its entirety around the first spool; and to be separated farther from the rotation center of the second spool than the maximum outer circumference of the ink ribbon taken up by the second spool is from the rotation center of the first spool.

9. A ribbon cassette comprising:

a cassette case having a box shape;

an ink ribbon accommodated in the cassette case and having a portion exposed to an outside of the cassette case between a first hole formed in a first outer wall of the cassette case and a second hole formed in a second outer wall of the cassette case;

a first spool rotatably supported to the cassette case and having a hollow cylindrical shape, one end portion of the ink ribbon being wound on the first spool;

a second spool rotatably supported to the cassette case and having a hollow cylindrical shape, the second spool having a first portion to which another end portion of the ink ribbon is connected;

an engaging part provided in the cassette case; and a spring member wound around a second portion of the second spool, the second portion being different from the first portion, wherein the spring member includes a winding part wound around the second portion, and an extension part extending from a first end portion of the winding part and engaged with the engaging part;

wherein the winding part is wound, from the first end portion, in a winding direction opposite to a take-up direction of the second spool in which the ink ribbon is taken up by the second spool;

wherein the engaging part is disposed at a position separated farther away from a rotation center of the second spool than a maximum outer circumference of the ink ribbon taken up by the second spool is from the rotation center of the second spool, the maximum outer circumference being defined by taking up the ink ribbon in its entirety around the second spool;

wherein the second spool comprises a flange configured to retain the taken up ink ribbon, the flange extending in a direction away from the rotation center of the second spool;

wherein the flange has a diameter greater than a diameter of the ink ribbon defined when the ink ribbon in its entirety is taken up by the second spool; and wherein the extension part has a portion extending along and in contact with the flange at a position opposite to the ink ribbon with respect to the flange.

10. The ribbon cassette according to claim 9, wherein the extension part extends from the first end portion in a tangential direction at the first end portion.

11. The ribbon cassette according to claim 9, wherein the winding part has a second end portion opposite to the first end portion, the first end portion being closer to the flange than the second end portion is to the flange.

12. The ribbon cassette according to claim 9, wherein the extension part has a tip end portion from which an anchoring part extends in a predetermined direction different from an extending direction of the extension part.

13. The ribbon cassette according to claim 12, wherein the predetermined direction is opposite to a direction toward the rotation center of the second spool from the first end portion.

14. The ribbon cassette according to claim 9, wherein the engaging part is positioned:

between a rotation center of the first spool and the rotation center of the second spool; and at a side on which the portion of the ink ribbon exposed to the outside is positioned with respect to an imaginary line connecting the rotation center of the first spool and the rotation center of the second spool;

to be separated farther from the rotation center of the first spool than a maximum outer circumference of the ink ribbon wound around the first spool is from the rotation center of the first spool, the maximum outer circumference being defined by winding the ink ribbon in its entirety around the first spool; and to be separated farther from the rotation center of the second spool than the maximum outer circumference of the ink ribbon taken up by the second spool is from the rotation center of the first spool.

15. A ribbon cassette comprising:

a cassette case having a box shape;

an ink ribbon accommodated in the cassette case and having a portion exposed to an outside of the cassette case between a first hole formed in a first outer wall of the cassette case and a second hole formed in a second outer wall of the cassette case;

a first spool rotatably supported to the cassette case and having a hollow cylindrical shape, one end portion of the ink ribbon being wound on the first spool;

a second spool rotatably supported to the cassette case and having a hollow cylindrical shape, the second spool having a first portion to which another end portion of the ink ribbon is connected;

an engaging part provided in the cassette case; and a spring member wound around a second portion of the second spool, the second portion being different from the first portion, wherein the spring member includes a winding part wound around the second portion, and an extension part extending from a first end portion of the winding part and engaged with the engaging part;

wherein the winding part is wound, from the first end portion, in a winding direction opposite to a take-up direction of the second spool in which the ink ribbon is taken up by the second spool;

wherein the engaging part is disposed at a position separated farther away from a rotation center of the second spool than a maximum outer circumference of the ink ribbon taken up by the second spool is from the rotation center of the second spool, the maximum outer circumference being defined by taking up the ink ribbon in its entirety around the second spool;

wherein the extension part has a tip end portion from which an anchoring part extends in a predetermined direction different from an extending direction of the extension part; and wherein the anchoring part is positioned farther away from the rotation center of the second spool than the engaging part is from the rotation center of the second spool, the anchoring part being movable between a separated position separated from the engaging part and a contact position contacting with the engaging part.

16. The ribbon cassette according to claim 15, wherein the predetermined direction is opposite to a direction toward the rotation center of the second spool from the first end portion.

17. The ribbon cassette according to claim 15, wherein the extension part extends from the first end portion in a tangential direction at the first end portion.

18. The ribbon cassette according to claim 15, wherein the engaging part is positioned:

between a rotation center of the first spool and the rotation center of the second spool; and at a side on which the portion of the ink ribbon exposed to the outside is positioned with respect to an imaginary line connecting the rotation center of the first spool and the rotation center of the second spool;

to be separated farther from the rotation center of the first spool than a maximum outer circumference of the ink ribbon wound around the first spool is from the rotation center of the first spool, the maximum outer circumference being defined by winding the ink ribbon in its entirety around the first spool; and to be separated farther from the rotation center of the second spool than the maximum outer circumference of the ink ribbon taken up by the second spool is from the rotation center of the first spool.

19. A ribbon cassette comprising:

a cassette case having a box shape;

an ink ribbon accommodated in the cassette case and having a portion exposed to an outside of the cassette case between a first hole formed in a first outer wall of the cassette case and a second hole formed in a second outer wall of the cassette case;

a first spool rotatably supported to the cassette case and having a hollow cylindrical shape, one end portion of the ink ribbon being wound on the first spool;

a second spool rotatably supported to the cassette case and having a hollow cylindrical shape, the second spool having a first portion to which another end portion of the ink ribbon is connected;

an engaging part provided in the cassette case; and a spring member wound around a second portion of the second spool, the second portion being different from the first portion, wherein the spring member includes a winding part wound around the second portion, and an extension part extending from a first end portion of the winding part and engaged with the engaging part;

wherein the winding part expands in diameter by contacting the extension part against the engaging part when the second spool is applied with an external force to rotate the second spool in a take-up direction in which the ink ribbon is taken up by the second spool, and the winding part contracts in diameter by contacting the extension part against the engaging part when the second spool is applied with an external force to rotate the second spool in a direction opposite to the take-up direction while the extension part elastically deforms; and wherein a second draw-out load applied to the ink ribbon being pulled from the second spool through the second hole is smaller than a first draw-out load applied to the ink ribbon being pulled from the first spool through the first hole.

20. The ribbon cassette according to claim 19, wherein the extension part extends from the first end portion in a tangential direction at the first end portion.

21. The ribbon cassette according to claim 19, wherein the second spool comprises a flange configured to retain the taken up ink ribbon, the flange extending in a direction away from a rotation center of the second spool;

wherein the flange has a diameter greater than a diameter of the ink ribbon defined when the ink ribbon in its entirety is taken up by the second spool; and wherein the extension part has a portion extending along and in contact with the flange at a position opposite to the ink ribbon with respect to the flange.

22. The ribbon cassette according to claim 21, wherein the winding part has a second end portion opposite to the first end portion, the first end portion being closer to the flange than the second end portion is to the flange.

23. The ribbon cassette according to claim 19, wherein the extension part has a tip end portion from which an anchoring part extends in a predetermined direction different from an extending direction of the extension part.

24. The ribbon cassette according to claim 23, wherein the predetermined direction is opposite to a direction toward a rotation center of the second spool from the first end portion.

25. The ribbon cassette according to claim 23, wherein the anchoring part is positioned farther away from a rotation center of the second spool than the engaging part is from the rotation center of the second spool, the anchoring part being movable between a separated position separated from the engaging part and a contact position contacting with the engaging part.

26. The ribbon cassette according to according to claim 19, wherein the engaging part is positioned:

between a rotation center of the first spool and a rotation center of the second spool; and at a side on which the portion of the ink ribbon exposed to the outside is positioned with respect to an imaginary line connecting the rotation center of the first spool and the rotation center of the second spool; and to be separated farther from the rotation center of the first spool than a maximum outer circumference of the ink ribbon wound around the first spool is from the rotation center of the first spool, the maximum outer circumference being defined by winding the ink ribbon in its entirety around the first spool; and to be separated farther from the rotation center of the second spool than the maximum outer circumference of the ink ribbon taken up by the second spool is from the rotation center of the first spool.

* * * * *